US012729690B2

(12) United States Patent
Shibata et al.

(10) Patent No.: US 12,729,690 B2
(45) Date of Patent: Sep. 8, 2026

(54) ELECTRIC CENTRIFUGAL COMPRESSOR

(71) Applicant: MITSUBISHI HEAVY INDUSTRIES ENGINE & TURBOCHARGER, LTD., Sagamihara (JP)

(72) Inventors: Naomichi Shibata, Sagamihara (JP); Byeongil An, Sagamihara (JP); Takaaki Yoshizawa, Sagamihara (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 147 days.

(21) Appl. No.: 18/273,202

(22) PCT Filed: Feb. 7, 2022

(86) PCT No.: PCT/JP2022/004662
§ 371 (c)(1),
(2) Date: Jul. 19, 2023

(87) PCT Pub. No.: WO2022/172885
PCT Pub. Date: Aug. 18, 2022

(65) Prior Publication Data

US 2024/0102479 A1 Mar. 28, 2024

(30) Foreign Application Priority Data

Feb. 12, 2021 (JP) ..... 2021-020356

(51) Int. Cl.
*F04D 17/10* (2006.01)
*F04D 17/12* (2006.01)
(Continued)

(52) U.S. Cl.
CPC ..... *F04D 17/122* (2013.01); *F04D 25/06* (2013.01); *F04D 29/056* (2013.01);
(Continued)

(58) Field of Classification Search
CPC ..... F04D 17/122; F04D 25/06; F04D 29/056; F04D 29/104; F04D 29/124; F04D 29/143; F04D 17/10; F16C 2360/44
(Continued)

(56) References Cited

U.S. PATENT DOCUMENTS 2,092,351 A * 9/1937 Huntzicker ..... F04D 29/146 277/377
2,936,715 A * 5/1960 Southam ..... F04D 29/146 277/377
(Continued)

FOREIGN PATENT DOCUMENTS

CN 102454626 A 5/2012
CN 106763791 A 5/2017
(Continued)

OTHER PUBLICATIONS

Japanese Office Action for Japanese Application No. 2021-020356, dated Dec. 3, 2024, with English translation.
(Continued)

*Primary Examiner* — Essama Omgba
*Assistant Examiner* — Dnyanesh G Kasture
(74) *Attorney, Agent, or Firm* — Birch, Stewart, Kolasch & Birch, LLP

(57) ABSTRACT

An electric centrifugal compressor includes: an electric motor including a rotational shaft; a first impeller disposed on one end side of the rotational shaft; a first bearing rotatably supporting the rotational shaft at a position between the first impeller and the electric motor and including a lubricant; and a first bearing housing accommodating the first bearing, The first bearing housing includes a compressed gas supply hole for supplying a compressed gas from outside of the first bearing housing to a gap between a rotating body including the rotational shaft and the first
(Continued)

bearing housing. An outlet of the compressed gas supply hole is disposed on an inner surface of the first bearing housing and is located between the first impeller and the first bearing in an axial direction of the rotational shaft.

8 Claims, 10 Drawing Sheets

(51) Int. Cl.
*F04D 25/06* (2006.01)
*F04D 29/056* (2006.01)
*F04D 29/10* (2006.01)
*F04D 29/12* (2006.01)
*F04D 29/14* (2006.01)

(52) U.S. Cl.
CPC ..... *F04D 29/104* (2013.01); *F04D 29/124* (2013.01); *F04D 29/143* (2013.01)

(58) Field of Classification Search
USPC ..... 277/431, 432
See application file for complete search history.

(56) References Cited

U.S. PATENT DOCUMENTS

| | | | | |
|---|---|---|---|---|
| 3,137,237 | A * | 6/1964 | Zagar | F16J 15/36 415/230 |
| 3,356,290 | A * | 12/1967 | Lehmann | G21D 1/04 415/176 |
| 3,847,504 | A * | 11/1974 | Martin | F04D 29/044 415/214.1 |
| 4,380,416 | A * | 4/1983 | Menager | F04D 29/126 415/174.3 |
| 4,447,062 | A * | 5/1984 | Leicht | G01F 23/241 277/447 |
| 4,734,018 | A * | 3/1988 | Taniyama | F04D 19/04 417/423.4 |
| 4,969,803 | A | 11/1990 | Turanskyj | |
| 5,856,992 | A * | 1/1999 | Karube | F16C 37/00 372/58 |
| 6,997,686 | B2 | 2/2006 | Agrawal et al. | |
| 9,605,683 | B2 | 3/2017 | Blair et al. | |
| 2005/0152780 | A1* | 7/2005 | Quill | F04D 29/106 415/206 |
| 2005/0248093 | A1* | 11/2005 | Keba | F16J 15/3404 277/358 |
| 2007/0036662 | A1* | 2/2007 | Pesola | F04D 17/12 417/423.5 |
| 2012/0230857 | A1 | 9/2012 | Noguchi | |
| 2015/0233384 | A1 | 8/2015 | Thompson et al. | |
| 2015/0275920 | A1 | 10/2015 | Thompson et al. | |
| 2016/0305450 | A1* | 10/2016 | An | F04D 25/06 |
| 2017/0058697 | A1* | 3/2017 | Copeland | F02C 7/06 |
| 2017/0321697 | A1 | 11/2017 | Beinert et al. | |
| 2021/0355954 | A1* | 11/2021 | Kvachnev | F04C 15/0038 |
| 2022/0154827 | A1* | 5/2022 | Brooks | F16J 15/406 |

FOREIGN PATENT DOCUMENTS

| | | | |
|---|---|---|---|
| CN | 107345519 | A | 11/2017 |
| FR | 2 765 653 | A1 | 1/1999 |
| JP | 53-27865 | B2 | 8/1978 |
| JP | 64-80799 | A | 3/1989 |
| JP | 2002-58194 | A | 2/2002 |
| JP | 2008-57452 | A | 3/2008 |
| JP | 2012-189009 | A | 10/2012 |
| JP | 2015-155696 | A | 8/2015 |
| JP | 2018-123759 | A | 8/2018 |
| JP | 6579649 | B2 | 9/2019 |
| WO | WO2017/084663 | A1 | 5/2017 |

OTHER PUBLICATIONS

Japanese Office Action for Japanese Application No. 2021-020356, dated Jan. 29, 2025, with an English translation.
International Preliminary Report on Patentability and English translation of the Written Opinion of the International Searching Authority for International Application No. PCT/JP2022/004662, dated Aug. 24, 2023.
International Search Report for International Application No. PCT/JP2022/004662, dated Apr. 5, 2022.
German Office Action for German Application No. 11 2022 000 301.4, dated Jul. 4, 2025, with a partial English translation.
Chinese Office Action and Search Report for Chinese Application No. 202280013281.7, dated Oct. 22, 2025, with English translation.
Chinese Office Action and Search Report for Chinese Application No. 202280013281.7, dated Apr. 17, 2026, with English translation of the Office Action.

* cited by examiner

ELECTRIC CENTRIFUGAL COMPRESSOR

TECHNICAL FIELD

The present disclosure relates to an electric centrifugal compressor.

The present application claims priority based on Japanese Patent Application No. 2021-020356 filed on Feb. 12, 2021, the entire content of which is incorporated herein by reference.

BACKGROUND ART

An electric centrifugal compressor may be mounted on a fuel cell vehicle which generates electricity with a fuel cell mounted on the vehicle body and runs on the power of an electric motor. The electric centrifugal compressor supplies compressed air to the fuel cell to improve the efficiency of the fuel cell.

In this type of electric centrifugal compressor, oil-free air bearings are mainly used because of the need to supply clean compressed air to the fuel cell (see Patent Document 1, for example).

CITATION LIST

Patent Literature

Patent Document 1: JP2015-155696A

SUMMARY

Problems to be Solved

When using an air bearing without lubricant as described in Patent Document 1, it is necessary to control the air around the bearing with a dedicated air pump or the like, which complicates the configuration of parts including the bearing housing around the bearing and tends to lead to higher costs.

In view of the above, an object of at least one embodiment of the present disclosure is to provide an electric centrifugal compressor that enables simplification of the parts around the bearing.

Solution to the Problems

An electric centrifugal compressor according to an embodiment of the present disclosure includes: an electric motor including a rotational shaft; a first impeller disposed on one end side of the rotational shaft; a first bearing rotatably supporting the rotational shaft at a position between the first impeller and the electric motor and including a lubricant; and a first bearing housing accommodating the first bearing. The first bearing housing includes a compressed gas supply hole for supplying a compressed gas from the outside of the first bearing housing to a gap between a rotating body including the rotational shaft and the first bearing housing. An outlet of the compressed gas supply hole is disposed on an inner surface of the first bearing housing and is located between the first impeller and the first bearing in an axial direction of the rotational shaft.

Advantageous Effects

At least one embodiment of the present disclosure provides an electric centrifugal compressor that enables simplification of the parts around the bearing.

DETAILED DESCRIPTION

Figure 1:
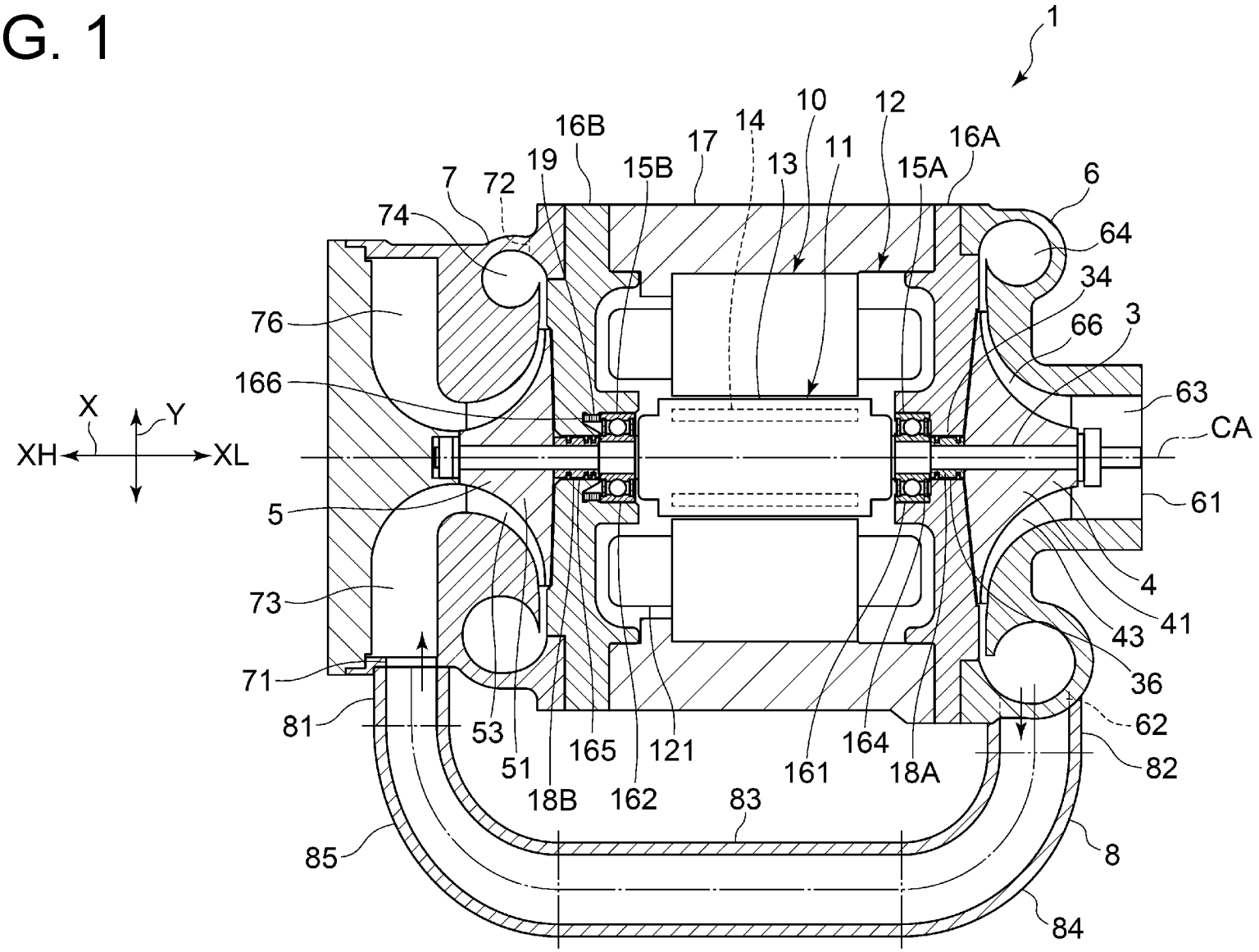
FIG. 1 is a cross-sectional view schematically showing a configuration of an electric centrifugal compressor 1 according to an embodiment of the present disclosure.

Embodiments of the present disclosure will be described below with reference to the accompanying drawings. It is intended, however, that unless particularly identified, dimensions, materials, shapes, relative positions, and the like of components described in the embodiments shall be interpreted as illustrative only and not intended to limit the scope of the present disclosure.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

The same features can be indicated by the same reference numerals and not described in detail.

(Multistage Electric Centrifugal Compressor)

FIG. 1 is a schematic configuration diagram schematically showing a configuration of an electric centrifugal compressor 1 according to an embodiment of the present disclosure. FIG. 1 schematically shows a cross-section of the electric centrifugal compressor 1 taken along a rotational axis CA of a rotational shaft 3.

As shown in FIG. 1, the electric centrifugal compressor 1 according to some embodiments of the present disclosure is a multistage electric centrifugal compressor configured to drive impellers (low-pressure-stage impeller 4, high-pressure-stage impeller 5) disposed at both ends of the rotational shaft 3 with an electric motor 10.

The electric centrifugal compressor 1 illustrated in FIG. 1 includes a low-pressure-stage impeller 4, a high-pressure-stage impeller 5, a low-pressure-stage housing 6, a high-pressure-stage housing 7, a connecting pipe 8, an electric motor 10, a low-pressure-stage-side bearing 15A, a high-pressure-stage-side bearing 15B, a low-pressure-stage-side bearing housing 16A, and a high-pressure-stage-side bearing housing 16B.

Hereinafter, as shown in FIG. 1, the extension direction of the rotational axis CA of the rotational shaft 3 is referred to as the axial direction X, and the direction perpendicular to the rotational axis CA is referred to as the radial direction Y In the axial direction X, the side (the right side in FIG. 1) where the low-pressure-stage impeller 4 is positioned with respect to the high-pressure-stage impeller 5 is referred to as the low-pressure stage side XL, and the side (the left side in FIG. 1) opposite to the low-pressure stage side XL is referred to as the high-pressure stage side XH.

(Electric Motor)

The electric motor 10 mounted on the electric centrifugal compressor 1 includes a rotating body 11 which is a rotor, a motor stator 12 which is a stator, and a stator housing 17 configured to accommodate the motor stator 12. The rotating body 11 includes the rotational shaft 3 and a rotor assembly 13 mounted on the outer periphery of the rotational shaft 3. The rotor assembly 13 includes a permanent magnet 14. The motor stator 12 is disposed so as to surround the outer periphery of the rotor assembly 13 and is supported by the stator housing 17 inside the stator housing 17. The motor stator 12 includes a motor coil (stator coil) 121 and is configured to generate a magnetic field for rotating the rotating body 11 equipped with the permanent magnet 14 by power supplied from a power source (not shown). When the rotating body 11 rotates due to the magnetic field generated by the motor stator 12 (power generated by the electric motor 10), the impellers (low-pressure-stage impeller 4 and high-pressure-stage impeller 5) mounted on the rotational shaft 3 rotate in tandem.

By rotating the low-pressure-stage impeller 4, the electric centrifugal compressor 1 compresses a gas introduced into the low-pressure-stage housing 6 to pressurize the gas to a first pressure. The compressed gas pressurized to the first pressure is led into the high-pressure-stage housing 7 through the connecting pipe 8. By rotating the high-pressure-stage impeller 5, the electric centrifugal compressor 1 further compresses the compressed gas introduced into the high-pressure-stage housing 7 to pressurize the compressed gas to a second pressure higher than the first pressure.

(Low-Pressure-Stage Housing and Low-Pressure-Stage Impeller)

As shown in FIG. 1, the low-pressure-stage housing 6 has a low-pressure-stage inlet opening 61 for introducing a gas from the outside to the inside of the low-pressure-stage housing 6, and a low-pressure-stage outlet opening 62 for discharging the gas from the inside to the outside of the low-pressure-stage housing 6. Inside the low-pressure-stage housing 6, a supply passage 63 for guiding the gas introduced into the low-pressure-stage housing 6 from the low-pressure-stage inlet opening 61 to the low-pressure-stage impeller 4, and a scroll passage 64 for guiding the gas that has passed through the low-pressure-stage impeller 4 to the low-pressure-stage outlet opening 62 are formed. In the illustrated embodiment, the low-pressure-stage inlet opening 61 opens toward the low-pressure stage side XL in the axial direction X. The low-pressure-stage outlet opening 62 opens in a direction intersecting (e.g., perpendicular to) the rotational axis CA.

In the embodiment shown in FIG. 1, the low-pressure-stage impeller 4 is disposed on one end side of the rotational shaft 3. The low-pressure-stage impeller 4 includes a hub 41 mechanically connected to one end of the rotational shaft 3 and a plurality of impeller blades 43 disposed on the outer peripheral surface of the hub 41. The low-pressure-stage impeller 4 can rotate in conjunction with the rotational shaft 3 about the rotational axis CA of the rotational shaft 3. The low-pressure-stage impeller 4 is composed of a centrifugal impeller configured to guide the gas sent from the low-pressure stage side XL along the axial direction X to the outer side in the radial direction Y. A gap (clearance) is formed between each of the tips of the impeller blades 43 and a convexly curved shroud surface of the low-pressure-stage housing 6.

In the embodiment shown in FIG. 1, the low-pressure-stage housing 6 is combined with another member (in the illustrated example, low-pressure-stage-side bearing housing 16A) to form a low-pressure-stage impeller chamber 66 rotatably accommodating the low-pressure-stage impeller 4. The low-pressure-stage impeller chamber 66 communicates with the supply passage 63 disposed upstream in the gas flow direction and the scroll passage 64 disposed downstream in the gas flow direction. The scroll passage 64 has a scroll shape surrounding the outer side of the low-pressure-stage impeller 4 in the radial direction Y.

The gas (e.g., air) introduced from the outside of the low-pressure-stage housing 6 to the supply passage 63 through the low-pressure-stage inlet opening 61 flows through the supply passage 63 to the high-pressure stage side XH, then is sent to the low-pressure-stage impeller 4, and is compressed by the rotation of the low-pressure-stage impeller 4 to be pressurized to the first pressure. The compressed gas (e.g., compressed air) having passed through the low-pressure-stage impeller 4 flows outward in the radial direction Y through the scroll passage 64, and then is discharged to the outside of the low-pressure-stage housing 6 through the low-pressure-stage outlet opening 62.

(High-Pressure-Stage Housing and High-Pressure-Stage Impeller)

As shown in FIG. 1, the high-pressure-stage housing 7 has a high-pressure-stage inlet opening 71 for introducing a gas from the outside to the inside of the high-pressure-stage housing 7, and a high-pressure-stage outlet opening 72 for discharging the gas from the inside to the outside of the high-pressure-stage housing 7. Inside the high-pressure-stage housing 7, a supply passage 73 for guiding the gas introduced into the high-pressure-stage housing 7 from the high-pressure-stage inlet opening 71 to the high-pressure-stage impeller 5, and a scroll passage 74 for guiding the gas that has passed through the high-pressure-stage impeller 5 to the high-pressure-stage outlet opening 72 are formed. In the illustrated embodiment, each of the high-pressure-stage inlet opening 71 and the high-pressure-stage outlet opening 72 open in a direction intersecting (e.g., perpendicular to) the rotational axis CA.

In the embodiment shown in FIG. 1, the high-pressure-stage impeller 5 is disposed on the other end side of the rotational shaft 3. The high-pressure-stage impeller 5 includes a hub 51 mechanically connected to the other end of the rotational shaft 3 and a plurality of impeller blades 53 disposed on the outer peripheral surface of the hub 51. The high-pressure-stage impeller 5 can rotate in conjunction with the rotational shaft 3 about the rotational axis CA of the rotational shaft 3. The high-pressure-stage impeller 5 is composed of a centrifugal impeller configured to guide the gas sent from the high-pressure stage side XH along the axial direction X to the outer side in the radial direction Y. A gap (clearance) is formed between each of the tips of the impeller blades 53 and a convexly curved shroud surface of the high-pressure-stage housing 7.

In the embodiment shown in FIG. 1, the high-pressure-stage housing 7 is combined with another member (in the illustrated example, high-pressure-stage-side bearing housing 16B) to form a high-pressure-stage impeller chamber 76 rotatably accommodating the high-pressure-stage impeller 5. The high-pressure-stage impeller chamber 76 communicates with the supply passage 73 disposed upstream in the gas flow direction and the scroll passage 74 disposed downstream in the gas flow direction. The scroll passage 74 has a scroll shape surrounding the outer side of the high-pressure-stage impeller 5 in the radial direction Y.

(Connecting Pipe)

As shown in FIG. 1, the electric centrifugal compressor 1 includes a connecting pipe 8 for supplying the compressed gas compressed by the low-pressure-stage impeller 4 to the high-pressure-stage housing 7. As shown in FIG. 1, the connecting pipe 8 is formed in a tubular shape extending along its longitudinal direction, and includes at least a high-pressure-stage-side connection portion 81 connected to the high-pressure-stage inlet opening 71 and a low-pressure-stage-side connection portion 82 connected to the low-pressure-stage outlet opening 62. In the illustrated embodiment, each of the high-pressure-stage-side connection portion 81 and the low-pressure-stage-side connection portion 82 extends in a direction intersecting (e.g., perpendicular to) the rotational axis CA of the rotational shaft 3.

The connecting pipe 8 further includes an intermediate portion 83 extending along the rotational axis CA of the rotational shaft 3, a low-pressure-stage-side curved portion 84 having a curved shape that connects the low-pressure-stage-side connection portion 82 and the intermediate portion 83, and a high-pressure-stage-side curved portion 85 having a curved shape that connects the high-pressure-stage-side connection portion 81 and the intermediate portion 83. In FIG. 1, the boundary of each portion of the connecting pipe 8 is shown by the dashed-dotted line. The portions of the connecting pipe 8 may be composed of separate members, or may be integrally formed from a single material.

The compressed gas discharged from the low-pressure-stage outlet opening 62 of the low-pressure-stage housing 6 flows through the connecting pipe 8 from the low-pressure-stage-side connection portion 82 to the high-pressure-stage-side connection portion 81, and then is introduced into the supply passage 73 through the high-pressure-stage inlet opening 71 of the high-pressure-stage housing 7. The compressed gas introduced into the supply passage 73 is sent to the high-pressure-stage impeller 5 and is compressed by the rotation of the high-pressure-stage impeller 5 to be pressurized to a second pressure higher than the first pressure. The compressed gas having passed through the high-pressure-stage impeller 5 flows outward in the radial direction Y through the scroll passage 74, and then is discharged to the outside of the high-pressure-stage housing 7 through the high-pressure-stage outlet opening 72.

In the illustrated embodiment, the electric centrifugal compressor 1 comprises an electric centrifugal compressor for a fuel cell vehicle. Therefore, the compressed gas compressed by the high-pressure-stage impeller 5 is supplied to a cathode of a fuel cell (not shown). The present disclosure may be applied to an electric centrifugal compressor other than that for a fuel cell vehicle, for example, an electric centrifugal compressor for an internal combustion engine for pressurizing a combustion gas supplied to an internal combustion engine such as an engine.

With the above configuration, the high-pressure-stage housing 7 has the high-pressure-stage inlet opening 71 that opens in a direction intersecting the rotational axis CA of the rotational shaft 3, and the high-pressure-stage-side connection portion 81 of the connecting pipe 8 is connected to the high-pressure-stage inlet opening 71. Accordingly, the compressed gas pressurized by the low-pressure-stage impeller 4 is supplied from the outer peripheral side (the outer side in the radial direction Y) of the high-pressure-stage housing 7 into the high-pressure-stage housing 7 through the connecting pipe 8. In this case, as compared to the case where the compressed gas is introduced into the high-pressure-stage housing 7 along the axial direction X of the rotational shaft 3, the length of the connecting pipe 8 and the high-pressure-stage housing 7 in the axial direction X can be shortened. As a result, the length of the electric centrifugal compressor 1 in the axial direction X can be shortened, so that the size and weight of the multistage electric centrifugal compressor can be reduced. Further, with the electric centrifugal compressor 1, a high pressure ratio can be achieved at low flow rates, and a multistage electric centrifugal compressor with excellent thrust load balance can be achieved.

(Bearing)

The low-pressure-stage-side bearing 15A rotatably supports the rotational shaft 3 at a position between the low-pressure-stage impeller 4 and the electric motor 10 (between the low-pressure-stage impeller 4 and the rotor assembly 13). The low-pressure-stage-side bearing 15A comprises a grease-filled ball bearing in which grease is previously filled as a lubricant. Compared to an air bearing, a ball bearing does not require idling, does not require a complex system, is more marketable, and is more durable to repeated rotation and stopping of the rotational shaft 3.

The high-pressure-stage-side bearing 15B rotatably supports the rotational shaft 3 at a position between the high-pressure-stage impeller 5 and the electric motor 10 (between the high-pressure-stage impeller 5 and the rotor assembly 13).

The high-pressure-stage-side bearing 15B comprises a grease-filled ball bearing in which grease is previously filled as a lubricant.

With the above configuration, since it is not necessary to supply grease to the low-pressure-stage-side bearing 15A, the structure of parts (e.g., low-pressure-stage-side bearing housing 16A) around the low-pressure-stage-side bearing 15A can be simplified, so that the size and weight of the multistage electric centrifugal compressor can be reduced. Further, since it is not necessary to supply grease to the high-pressure-stage-side bearing 15B, the structure of parts (e.g., high-pressure-stage-side bearing housing 16B) around the high-pressure-stage-side bearing 15B can be simplified, so that the size and weight of the multistage electric centrifugal compressor can be reduced.

(Bearing Housing)

The low-pressure-stage-side bearing housing 16A accommodates the low-pressure-stage-side bearing 15A, and the low-pressure-stage-side bearing 15A is supported by a bearing support surface 161 formed inside the low-pressure-stage-side bearing housing 16A. The high-pressure-stage-side bearing housing 16B accommodates the high-pressure-stage-side bearing 15B, and the high-pressure-stage-side bearing 15B is supported by a bearing support surface 162 formed inside the high-pressure-stage-side bearing housing 16B.

The low-pressure-stage-side bearing housing 16A and the high-pressure-stage-side bearing housing 17 are disposed in the axial direction X between the low-pressure-stage housing 6 and the high-pressure-stage housing 7. The stator housing 17 is disposed between the low-pressure-stage-side bearing housing 16A and the high-pressure-stage-side bearing housing 16B in the axial direction X and is adjacent to each of the low-pressure-stage-side bearing housing 16A and the high-pressure-stage-side bearing housing 16B.

The low-pressure-stage-side bearing housing 16A is disposed on the high-pressure stage side XH of the low-pressure-stage housing 6 and on the low-pressure stage side XL of the stator housing 17. The low-pressure-stage-side bearing housing 16A is mechanically connected to the low-pressure-stage housing 6 and the stator housing 17, which are disposed adjacent to the low-pressure-stage-side bearing housing 16A in the axial direction X, by fastening members such as fastening bolts. The high-pressure-stage-side bearing housing 16B is disposed on the low-pressure stage side XL of the high-pressure-stage housing 7 and on the high-pressure stage side XH of the stator housing 17. The high-pressure-stage-side bearing housing 16B is mechanically connected to the high-pressure-stage housing 7 and the stator housing 17, which are disposed adjacent to the high-pressure-stage-side bearing housing 16B in the axial direction X, by fastening members such as fastening bolts. Further detailed configurations of the low-pressure-stage-side bearing housing 16A and the high-pressure-stage-side bearing housing 16B will be described later.

(Sleeve)

In the illustrated embodiment, the electric centrifugal compressor 1 further includes a low-pressure-stage-side sleeve 18A mounted on the outer periphery of the rotational shaft 3 between the low-pressure-stage impeller 4 and the low-pressure-stage-side bearing 15A in the axial direction X, a high-pressure-stage-side sleeve 18B mounted on the outer periphery of the rotational shaft 3 between the high-pressure-stage impeller 5 and the high-pressure-stage-side bearing 15B in the axial direction X, and a pressurizing spring 19 that biases the high-pressure-stage-side bearing 15B toward the low-pressure stage side XL. The above-described rotating body 11 further includes the low-pressure-stage-side sleeve 18A and the high-pressure-stage-side sleeve 18B.

The low-pressure-stage-side bearing housing 16A has an inner surface (sleeve-facing surface) 36 that faces an outer peripheral surface 34 of the low-pressure-stage-side sleeve 18A and an engagement surface 164 that extends inward in the radial direction from the end portion of the bearing support surface 161 on the low-pressure stage side XL and engages the low-pressure-stage-side bearing 15A. The inner surface 36 is formed to have a smaller diameter than the bearing support surface 161. The high-pressure-stage-side bearing housing 16B has an inner surface (sleeve-facing surface) 165 that faces an outer peripheral surface 181 of the high-pressure-stage-side sleeve 18B and an engagement surface 166 that extends inward in the radial direction from the end portion of the bearing support surface 162 on the high-pressure stage side XH. The inner surface 165 is formed to have a smaller diameter than the bearing support surface 162. The pressurizing spring 19 is disposed between the engagement surface 166 and the high-pressure-stage-side bearing 15B to apply a predetermined pressure to the high-pressure-stage-side bearing 15B.

Figure 2:
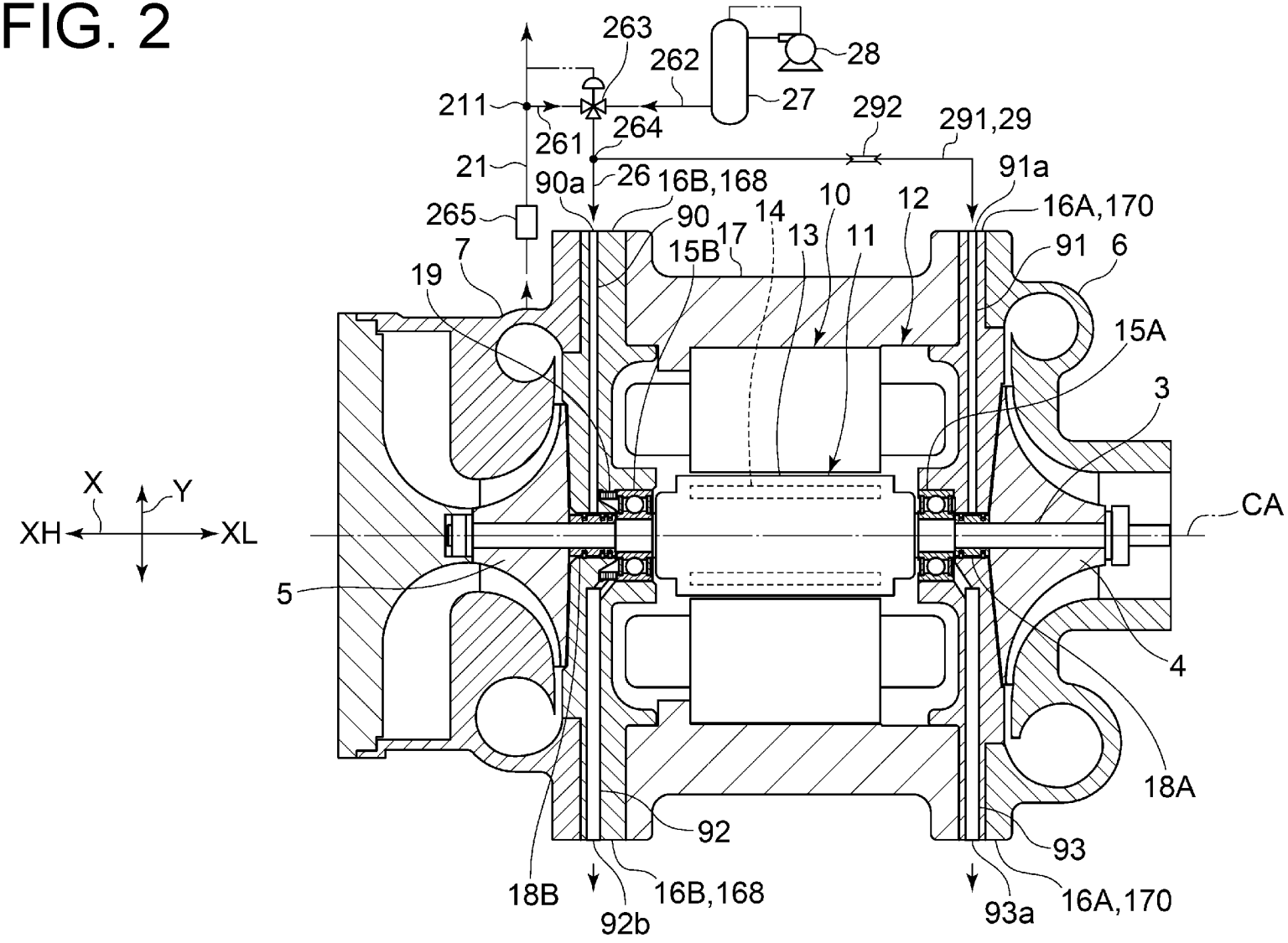
FIG. 2 is a diagram showing a cross-section of the electric centrifugal compressor 1 shown in FIG. 1 at a different circumferential position from the cross-section shown in FIG. 1.
Figure 3:
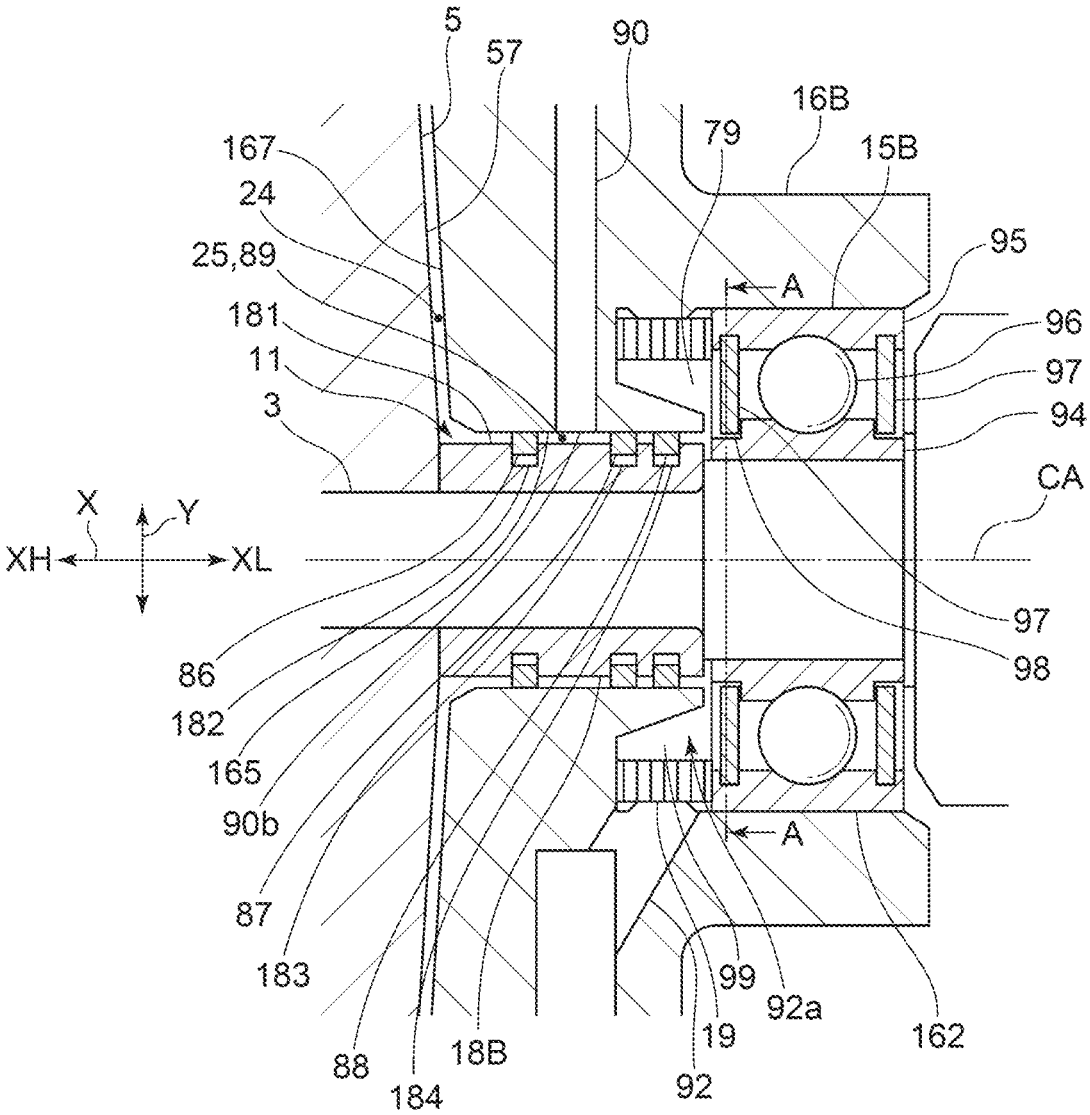
FIG. 3 is an enlarged view in the vicinity of a high-pressure-stage-side sleeve 18B in the cross-section shown in FIG. 2.
Figure 4:
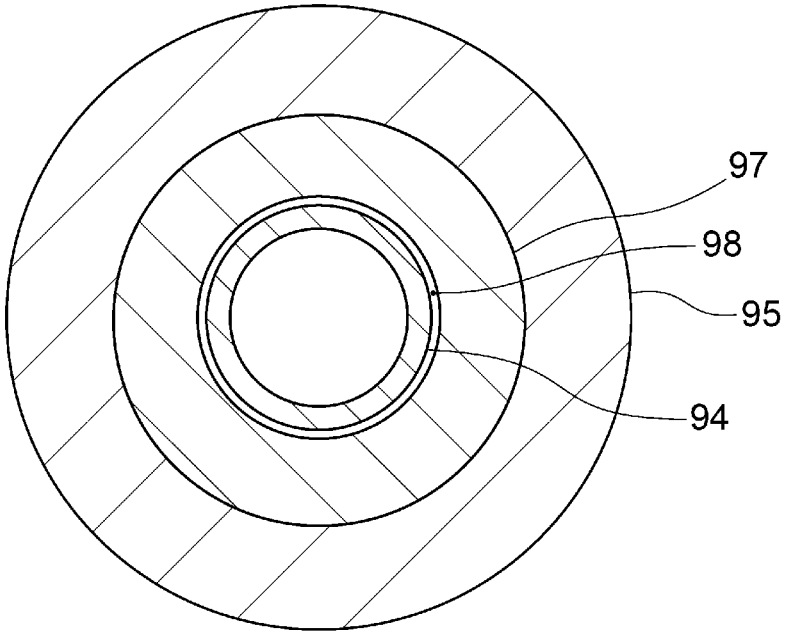
FIG. 4 is a schematic cross-sectional view taken along line A-A in FIG. 3.
Figure 5:
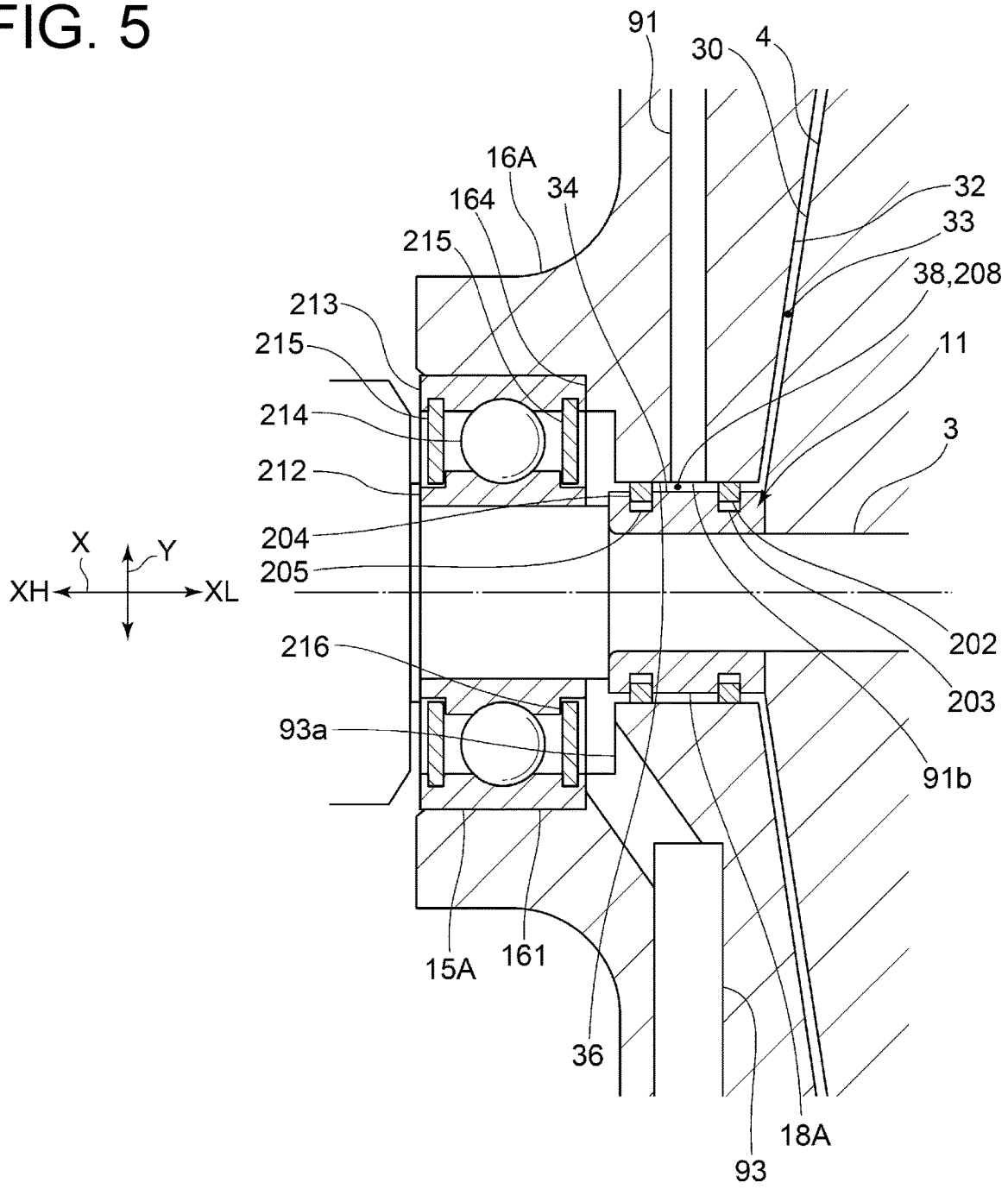
FIG. 5 is an enlarged view in the vicinity of a low-pressure-stage-side sleeve 18A in the cross-section shown in FIG. 2.

FIG. 2 is a diagram showing a cross-section of the electric centrifugal compressor 1 shown in FIG. 1 at a different circumferential position from the cross-section shown in FIG. 1. The cross-section shown in FIG. 2 is a cross-section along the rotational axis CA. FIG. 3 is an enlarged view in the vicinity of the high-pressure-stage-side sleeve 18B in the cross-section shown in FIG. 2. FIG. 4 is a schematic cross-sectional view taken along line A-A in FIG. 3. FIG. 5 is an enlarged view in the vicinity of the low-pressure-stage-side sleeve 18A in the cross-section shown in FIG. 2.

(Compressed Air Supply Hole on High Pressure Stage Side)

As shown in FIG. 2 or 3, the high-pressure-stage-side bearing housing 16B includes a compressed air supply hole 90 for supplying the compressed air to a gap 25 between the rotating body 11 including the rotational shaft 3 and the high-pressure-stage-side bearing housing 16B (in the illustrated example, a gap between the outer peripheral surface 181 of the high-pressure-stage-side sleeve 18B and the inner surface 165 of the high-pressure-stage-side bearing housing 16B). The compressed air supply hole 90 is formed as a through hole that penetrates the high-pressure-stage-side bearing housing 16B along the radial direction from the outer surface 168 to the inner surface 165 of the high-pressure-stage-side bearing housing 16B. An inlet 90*a* of the compressed air supply hole 90 is formed on the outer surface 168 of the high-pressure-stage-side bearing housing 16B, and an outlet 90*b* of the compressed air supply hole 90 is formed on the inner surface 165 of the high-pressure-stage-side bearing housing 16B. The outlet 90*b* of the compressed air supply hole 90 is located between the high-pressure-stage impeller 5 and the high-pressure-stage-side bearing 15B in the axial direction.

As shown in FIG. 2, the electric centrifugal compressor 1 includes a compressed air introduction line 26 configured to introduce the compressed air from a pressure source (e.g., compressed air supply line 21 or surge tank 27) to the inlet 90*a* of the compressed air supply hole 90.

The compressed air introduction line 26 is configured to introduce the compressed air from each of the compressed air supply line 21 and the surge tank 27 to the inlet 90*a* of the compressed air supply hole 90. The gas in the surge tank 27 has a higher pressure than in a space 24, which will be described later, due to a compressor 28. The compressed air introduction line 26 includes a first pipe 261 connected at one end to a branch portion 211 of the compressed air supply line 21 and at the other end to the inlet 90*a*, a second pipe 262 connected at one end to the first pipe 261 and at the other end to the surge tank 27, and a switching device 263 configured to switch the source of the compressed air to the inlet 90*a* to either the compressed air supply line 21 or the surge tank 27. The compressed air supply line 21 is provided with a cooling device 265 for cooling the compressed air. In another embodiment, the cooling device 265 may be provided on the first pipe 261 upstream of the switching device 263 (between the branch portion 211 and the switching device 263 on the first pipe 261).

The switching device 263 may be a three-way valve disposed at the connection between the first pipe 261 and the second pipe 262, as shown in FIG. 2, or may be valves (e.g., open/close valve) disposed upstream of the connection between the first pipe 261 and the second pipe 262 on the second pipe 262. In other embodiments, the compressed air introduction line 26 may include a pipe connected at one end to the surge tank 27 and at the other end to the inlet 90*a* and may be configured to introduce the compressed air from only the surge tank 27 to the inlet 90*a*. By configuring the system to allow the compressed air to be supplied from the compressed air supply line 21 to the inlet 90*a*, the surge tank 27 can have a small capacity.

As shown in FIG. 3, a space 24 is formed between the back surface 57 of the high-pressure-stage impeller 5 and a high-pressure-stage-side surface 167 of the high-pressure-stage-side bearing housing 16B that faces the back surface 57. The gap 25 formed between the outer peripheral surface 181 of the high-pressure-stage-side sleeve 18B and the inner surface 165 of the high-pressure-stage-side bearing housing 16B communicates with the space 24.

In the illustrated embodiment, as shown in FIG. 3, the outer peripheral surface 181 of the high-pressure-stage-side sleeve 18B has an annular groove 182 in which a seal element (e.g., annular seal ring) 86 is fitted, an annular groove 183 in which a seal element (e.g., annular seal ring) 87 is fitted, and an annular groove 184 in which a seal element (e.g., annular seal ring) 88 is fitted.

The annular groove 182 is located between the high-pressure-stage impeller 5 and the outlet 90*b* of the compressed air supply hole 90 in the axial direction X. The seal element 86 is disposed so as to seal the gap 25 at a position between the high-pressure-stage impeller 5 and the outlet 90*b* of the compressed air supply hole 90 in the axial direction X.

The annular groove 183 is located between the outlet 90*b* of the compressed air supply hole 90 and the high-pressure-stage-side bearing 15B in the axial direction. Thus, the outlet 90*b* of the compressed air supply hole 90 is located between the annular groove 182 and the annular groove 183 in the axial direction X. The seal element 87 is disposed so as to seal the gap 25 at a position between the outlet 90*b* of the compressed air supply hole 90 and the high-pressure-stage-side bearing 15B in the axial direction.

The annular groove 184 is located between the outlet 90*b* of the compressed air supply hole 90 and the high-pressure-stage-side bearing 15B in the axial direction (more specifically, between the annular groove 183 and the high-pressure-stage-side bearing 15B in the axial direction). The seal element 88 is disposed so as to seal the gap 25 at a position between the outlet of the compressed air supply hole 90 and the high-pressure-stage-side bearing 15B in the axial direction (more specifically, between the annular groove 183 and the high-pressure-stage-side bearing 15B in the axial direction). The outer surfaces of the seal element 86, the seal element 87, and the seal element 88 are in contact with the outer peripheral surface 181 of the high-pressure-stage-side sleeve 18B to divide the gap 25 into a plurality of sections.

When the high-pressure-stage impeller 5 rotates, the temperature and pressure of the gas in the space 24 rise. When the gas in the space 24 passes through the gap 25 and flows to the high-pressure-stage-side bearing 15B, there is a risk of grease in the high-pressure-stage-side bearing 15B becoming oil mist and deteriorating the high-pressure-stage-side bearing 15B.

In this regard, with the above configuration, the high-pressure-stage-side bearing housing 16B includes the compressed air supply hole 90 for supplying the compressed gas from the outside of the high-pressure-stage-side bearing housing 16B to the gap 25 between the rotating body 11 including the rotational shaft 3 and the high-pressure-stage-side bearing housing 16B, and the outlet 90*b* of the compressed air supply hole 90 is formed on the inner surface 165 of the high-pressure-stage-side bearing housing 16B and is located between the high-pressure-stage impeller 5 and the high-pressure-stage-side bearing 15B in the axial direction X.

This allows the compressed gas to be supplied from the compressed air supply hole 90 to the gap 25, thereby suppressing leakage flow from the space 24 facing the back surface 57 of the high-pressure-stage impeller 5 to the high-pressure-stage-side bearing 15B. This suppresses the oil misting of grease in the high-pressure-stage-side bearing 15B caused by the leakage flow, thereby improving the durability and increasing the service life of the high-pressure-stage-side bearing 15B.

Further, when the compressed air is supplied from the compressed air introduction line 26 to the inlet 90*a* of the compressed air supply hole 90 so that the pressure in a space 89 of the gap 25 between the seal element 86 and the seal element 87 is larger than the pressure in the space 24 of the gap 25 adjacent to the back surface of the high-pressure-stage impeller 5, it is possible to effectively suppress leakage flow from the space 24 facing the back surface 57 of the high-pressure-stage impeller 5 to the high-pressure-stage-side bearing 15B.

Further, when the compressed air is supplied from the compressed air introduction line 26 to the inlet 90*a* of the compressed air supply hole 90 so that the pressure in the space 89 of the gap 25 between the seal element 86 and the seal element 87 is larger than the pressure in a space 79 of the gap 25 accommodating the high-pressure-stage-side bearing 15B (a space between the seal element 88 and the high-pressure-stage-side bearing 15B), it is possible to prevent the grease filled in the high-pressure-stage-side bearing 15B from leaking to a flow path in the high-pressure-stage housing 7 through the gap 25 or the space 24. This prevents the grease from mixing with the compressed gas compressed by the electric centrifugal compressor 1, so that the electric centrifugal compressor 1 can supply clean compressed gas to the fuel cell or the like.

(Purge Hole on High Pressure Stage Side)

As shown in FIG. 2 or 3, the high-pressure-stage-side bearing housing 16B includes a purge hole 92 (purge passage) for discharging the compressed air supplied from the compressed air supply hole 90 to the gap 25 to the outside of the high-pressure-stage-side bearing housing 16B from the gap 25. The purge hole 92 is formed as a through hole that penetrates the high-pressure-stage-side bearing housing 16B along the radial direction from the outer surface 168 to the inner surface 165 of the high-pressure-stage-side bearing housing 16B. The inlet 92*a* of the purge hole 92 is formed on the inner surface 165 of the high-pressure-stage-side bearing housing 16B and is located between the high-pressure-stage impeller 5 and the high-pressure-stage-side bearing 15B in the axial direction X. In the example shown in FIG. 3, the inlet 92*a* of the purge hole 92 is formed adjacent to the high-pressure-stage impeller 5 on the bearing support surface 162 and opens to a space 99 accommodating the pressurizing spring 19. The outlet 92*b* of the purge hole 92 is formed on the outer surface 168 of the high-pressure-stage-side bearing housing 16B.

With the above configuration, the compressed air supplied to the gap 25 is discharged to the outside of the high-pressure-stage-side bearing housing 16B through the purge hole 92, so that the compressed air supplied to the gap 25 is prevented from entering the inside of the high-pressure-stage-side bearing 15B. This suppresses the oil misting of grease in the high-pressure-stage-side bearing 15B, thereby improving the durability and increasing the service life of the high-pressure-stage-side bearing 15B.

As shown in FIG. 3 or 4, the high-pressure-stage-side bearing 15B includes an inner ring 94, an outer ring 95, a plurality of balls 96 (a plurality of rolling elements) held between the inner ring 94 and the outer ring 95, and a pair of annular seal plates 97 located on both sides of the balls 96 in the axial direction X and held by the outer ring 95. Here, when an annular gap formed between the inner ring 94 and an annular seal plate 97 of the pair of annular seal plates 97 closer to the high-pressure-stage impeller 5 is defined as a seal plate gap 98, and the cross-sectional area of the seal plate gap 98 perpendicular to the axial direction X (area of the annular seal plate gap 98 shown in FIG. 4) is defined as S1, the purge hole 92 has a larger path cross-sectional area S2 than the cross-sectional area S1. The purge hole 92 may have a larger path cross-sectional area S2 than the cross-sectional area S1 from the inlet 92*a* to the outlet 92*b*. The path cross-sectional area of the purge hole 92 means the cross-sectional area perpendicular to the flow direction of the compressed air in the purge hole 92 (cross-sectional area perpendicular to the extension direction of the purge hole 92).

Thus, when the purge hole 92 has a larger path cross-sectional area S2 than the cross-sectional area S1 of the seal plate gap 98, the flow of the compressed air supplied to the gap 25 into the purge hole 92 is encouraged, and the compressed air is prevented from entering the inside of the high-pressure-stage-side bearing 15B through the gap 25. This suppresses the oil misting of grease in the high-pressure-stage-side bearing 15B, thereby improving the durability and increasing the service life of the high-pressure-stage-side bearing 15B.

(Compressed Air Supply Hole on Low Pressure Stage Side)

As shown in FIG. 2 or 5, the low-pressure-stage-side bearing housing 16A includes a compressed air supply hole 91 for supplying the compressed air to a gap 38 between the rotating body 11 including the rotational shaft 3 and the low-pressure-stage-side bearing housing 16A (in the illustrated example, a gap between the outer peripheral surface 34 of the low-pressure-stage-side sleeve 18A and the inner surface 36 of the low-pressure-stage-side bearing housing 16A). The compressed air supply hole 91 is formed as a through hole that penetrates the high-pressure-stage-side bearing housing 16B along the radial direction from the outer surface 170 to the inner surface 36 of the low-pressure-stage-side bearing housing 16A. An inlet 91*a* of the compressed air supply hole 91 is formed on the outer surface 170 of the low-pressure-stage-side bearing housing 16A, and an outlet 91*b* of the compressed air supply hole 91 is formed on the inner surface 36 of the low-pressure-stage-side bearing housing 16A. The outlet 91*b* of the compressed air supply hole 91 is located between the low-pressure-stage impeller 4 and the low-pressure-stage-side bearing 15A in the axial direction.

The electric centrifugal compressor 1 includes a compressed air introduction line 29 configured to introduce the compressed air from a pressure source (e.g., compressed air supply line 21 or surge tank 27) to the inlet 91*a* of the compressed air supply hole 91. The compressed air introduction line 29 shares some equipment (pipes and valves) with the compressed air introduction line 26. That is, the compressed air introduction line 29 has a third pipe 291 connected at one end to a branch portion 264 of the first pipe 261 between the connection with the second pipe 262 and the inlet 91*a* and at the other end to the inlet 91*a*, and a pressure reducing valve 292 disposed on the third pipe 291. In some embodiments, the compressed air introduction line 29 may share no equipment with the compressed air introduction line 26.

As shown in FIG. 5, a space 33 is formed between the back surface 30 of the low-pressure-stage impeller 4 and a low-pressure-stage-side surface 32 of the low-pressure-stage-side bearing housing 16A that faces the back surface 30. The gap 38 formed between the outer peripheral surface 34 of the low-pressure-stage-side sleeve 18A and the inner surface 36 of the low-pressure-stage-side bearing housing 16A communicates with the space 33.

In the illustrated embodiment, as shown in FIG. 5, the outer peripheral surface 34 of the low-pressure-stage-side sleeve 18A has an annular groove 203 in which a seal element (e.g., annular seal ring) 202 is fitted, and an annular groove 205 in which a seal element (e.g., annular seal ring) 204 is fitted.

The annular groove 203 is located between the low-pressure-stage impeller 4 and the outlet 91*b* of the compressed air supply hole 91 in the axial direction X. The seal element 202 is disposed so as to seal the gap 38 at a position between the low-pressure-stage impeller 4 and the outlet 91*b* of the compressed air supply hole 91 in the axial direction X.

The annular groove 205 is located between the outlet 91*b* of the compressed air supply hole 91 and the low-pressure-stage-side bearing 15A in the axial direction. Thus, the outlet 91*b* of the compressed air supply hole 91 is located between the annular groove 203 and the annular groove 205 in the axial direction X. The seal element 204 is disposed so as to seal the gap 38 at a position between the outlet 91*b* of the compressed air supply hole 91 and the low-pressure-stage-side bearing 15A in the axial direction.

The outer surfaces of the seal element 202 and the seal element 204 are in contact with the outer peripheral surface 34 of the low-pressure-stage-side sleeve 18A to divide the gap 38 into a plurality of sections.

When the low-pressure-stage impeller 4 rotates, the temperature and pressure of the gas in the space 33 rise. When the gas in the space 33 passes through the gap 38 and flows to the low-pressure-stage-side bearing 15A, there is a risk of grease in the low-pressure-stage-side bearing 15A becoming oil mist and deteriorating the low-pressure-stage-side bearing 15A.

In this regard, with the above configuration, the low-pressure-stage-side bearing housing 16A includes the compressed air supply hole 91 for supplying the compressed gas from the outside of the low-pressure-stage-side bearing housing 16A to the gap 38 between the rotating body 11 including the rotational shaft 3 and the low-pressure-stage-side bearing housing 16A, and the outlet 91*b* of the compressed air supply hole 91 is formed on the inner surface 36 of the low-pressure-stage-side bearing housing 16A and is located between the low-pressure-stage impeller 4 and the low-pressure-stage-side bearing 15A in the axial direction X.

This allows the compressed gas to be supplied from the compressed air supply hole 91 to the gap 38, thereby suppressing leakage flow from the space 33 adjacent to the back surface 30 of the low-pressure-stage impeller 4 to the low-pressure-stage-side bearing 15A. This suppresses the oil misting of grease in the low-pressure-stage-side bearing 15A caused by the leakage flow, thereby improving the durability and increasing the service life of the low-pressure-stage-side bearing 15A.

Further, when the compressed air is supplied from the compressed air introduction line 29 to the inlet 91*a* of the compressed air supply hole 91 so that the pressure in a space 206 of the gap 38 between the seal element 202 and the seal element 204 is larger than the pressure in the space 33 of the gap 25 adjacent to the back surface 30 of the low-pressure-stage impeller 4, it is possible to effectively suppress leakage flow from the space 33 adjacent to the back surface 30 of the low-pressure-stage impeller 4 to the low-pressure-stage-side bearing 15A.

Further, when the compressed air is supplied from the compressed air introduction line 29 to the inlet 91*a* of the compressed air supply hole 91 so that the pressure in the space 206 of the gap 38 between the seal element 202 and the seal element 204 is larger than the pressure in a space 208 of the gap 38 accommodating the low-pressure-stage-side bearing 15A (a space between the seal element 204 and the low-pressure-stage-side bearing 15A), it is possible to prevent the grease filled in the low-pressure-stage-side bearing 15A from leaking to a flow path in the low-pressure-stage housing 6 through the gap 38 or the space 33. This prevents the grease from mixing with the compressed gas compressed by the electric centrifugal compressor 1, so that the electric centrifugal compressor 1 can supply clean compressed gas to the fuel cell or the like.

(Purge Hole on Low Pressure Stage Side)

As shown in FIGS. 2 and 5, the low-pressure-stage-side bearing housing 16A includes a purge hole 93 for discharging the compressed air supplied from the compressed air supply hole 91 to the gap 38 to the outside of the low-pressure-stage-side bearing housing 16A from the gap 38. The purge hole 93 is formed as a through hole that penetrates the low-pressure-stage-side bearing housing 16A along the radial direction from the outer surface 170 to the inner surface 36 of the low-pressure-stage-side bearing housing 16A. The inlet 93*a* of the purge hole 93 is formed on the inner surface 36 of the low-pressure-stage-side bearing housing 16A and is located between the low-pressure-stage impeller 4 and the low-pressure-stage-side bearing 15A in the axial direction X (in the illustrated example, between the seal element 204 and the low-pressure-stage-side bearing 15A in the axial direction X). The outlet 93*b* of the purge hole 93 is formed on the outer surface 170 of the low-pressure-stage-side bearing housing 16A.

With the above configuration, the compressed air supplied to the gap 38 is discharged to the outside of the low-pressure-stage-side bearing housing 16A through the purge hole 93, so that the compressed air supplied to the gap 38 is prevented from entering the inside of the low-pressure-stage-side bearing 15A. This suppresses the oil misting of grease in the low-pressure-stage-side bearing 15A, thereby improving the durability and increasing the service life of the low-pressure-stage-side bearing 15A.

As shown in FIG. 5, the low-pressure-stage-side bearing 15A includes an inner ring 212, an outer ring 213, a plurality of balls 214 as rolling elements held between the inner ring 212 and the outer ring 213, and a pair of annular seal plates 215 located on both sides of the balls 214 in the axial direction X and held by the outer ring 213. Here, when an annular gap formed between the inner ring 212 and an annular seal plate 215 of the pair of annular seal plates 215 closer to the high-pressure-stage impeller 5 is defined as a seal plate gap 216, and the cross-sectional area of the seal plate gap 216 perpendicular to the axial direction X is defined as S3, the purge hole 93 has a larger path cross-sectional area S4 than the cross-sectional area S1. The purge hole 93 may have a larger path cross-sectional area S4 than the cross-sectional area S3 from the inlet 93*a* to the outlet 93*b*. The path cross-sectional area of the purge hole 93 means the cross-sectional area perpendicular to the flow direction of the compressed air in the purge hole 93 (cross-sectional area perpendicular to the extension direction of the purge hole 93).

Thus, when the purge hole 93 has a larger path cross-sectional area than the cross-sectional area of the seal plate gap 216, the flow of the compressed air supplied to the gap 38 into the purge hole 93 is encouraged, and the compressed air is prevented from entering the inside of the low-pressure-stage-side bearing 15A through the gap 38. This suppresses the oil misting of grease in the low-pressure-stage-side bearing 15A, thereby improving the durability and increasing the service life of the low-pressure-stage-side bearing 15A.

(Lip Seal)

Figure 6:
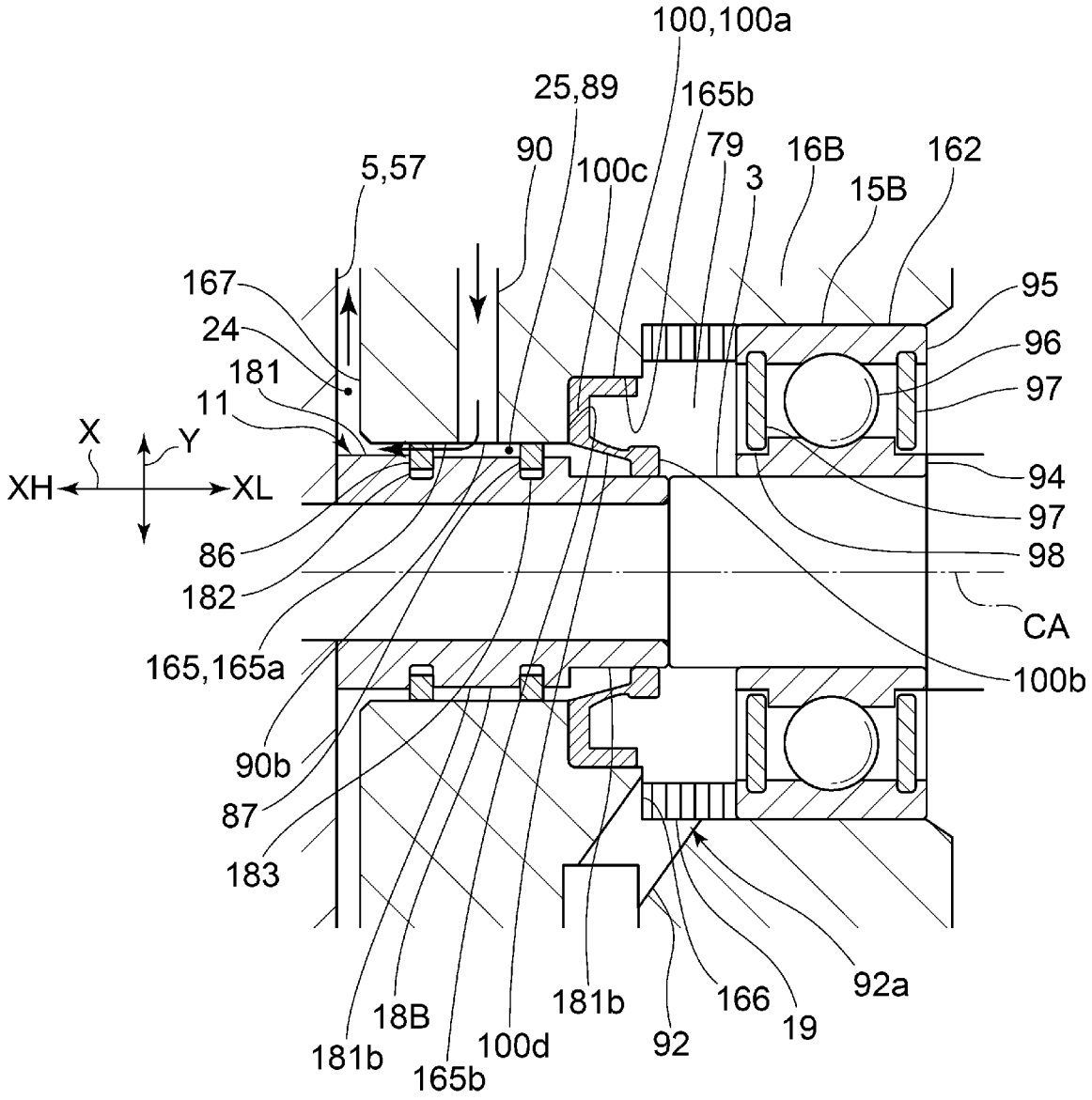
FIG. 6 is an enlarged view in the vicinity of a high-pressure-stage-side sleeve 18B of an electric centrifugal compressor 1 according to an embodiment and schematically shows a cross-section taken along a rotational axis CA of the electric centrifugal compressor 1.

FIG. 6 is an enlarged view in the vicinity of the high-pressure-stage-side sleeve 18B of the electric centrifugal compressor 1 according to an embodiment and schematically shows a cross-section taken along the rotational axis CA of the electric centrifugal compressor 1. In the following configuration, unless otherwise stated, common reference characters with those in the aforementioned configuration denote the same constituent components as those in the aforementioned configuration, and the description thereof will be omitted.

In the configuration shown in FIG. 3, etc., three seal elements 86 to 88 are provided on the outer peripheral surface 181 of the high-pressure-stage-side sleeve 18B, but in some embodiments, only two seal elements 86 and 87 may be provided on the outer peripheral surface 181 of the high-pressure-stage-side sleeve 18B, as shown in FIG. 6, for example.

The annular groove 182 is located between the high-pressure-stage impeller 5 and the outlet 90*b* of the compressed air supply hole 90 in the axial direction X. The seal element 86 is disposed so as to seal the gap 25 at a position between the high-pressure-stage impeller 5 and the outlet 90*b* of the compressed air supply hole 90 in the axial direction X.

The annular groove 183 is located between the outlet 90*b* of the compressed air supply hole 90 and the high-pressure-stage-side bearing 15B in the axial direction. Thus, the outlet 90*b* of the compressed air supply hole 90 is located between the annular groove 182 and the annular groove 183 in the axial direction X. The seal element 87 is disposed so as to seal the gap 25 at a position between the outlet 90*b* of the compressed air supply hole 90 and the high-pressure-stage-side bearing 15B in the axial direction.

The outer surfaces of the seal element 86 and the seal element 87 are in contact with the outer peripheral surface 181 of the high-pressure-stage-side sleeve 18B to divide the gap 25 into a plurality of sections.

In the embodiments shown in FIG. 6, the electric centrifugal compressor 1 further includes a lip seal 100 disposed so as to seal the gap 25 between the rotating body 11 including the rotational shaft 3 and the high-pressure-stage-side bearing housing 16B (in the illustrated example, a gap between the outer peripheral surface 181 of the high-pressure-stage-side sleeve 18B and the inner surface 165 of the high-pressure-stage-side bearing housing 16B) at a position between the seal element 87 and the high-pressure-stage-side bearing 15B in the axial direction X. A base end portion 100*a* of the lip seal 100 is fixed to the inner surface 165 of the high-pressure-stage-side bearing housing 16B, and a tip end portion 100*b* of the lip seal 100 is configured to come into contact with the outer peripheral surface 181 of the rotating body 11.

In the example shown in FIG. 6, the inner surface 165 of the high-pressure-stage-side bearing housing 16B includes a first inner surface 165*a*, where the outlet 90*b* of the compressed air supply hole 90 is formed, and a second inner surface 165*c*, which connects to the first inner surface 165*a* via a stepped surface 165*b*. The second inner surface 165*c* has a larger diameter than the first inner surface 165*a* and a smaller diameter than the bearing support surface. The lip seal 100 includes a base end portion 100*a* fixed to the second inner surface 165*c*, a first connection portion 100*c* extending inward in the radial direction along the stepped surface 165*b* from the end of the base end portion 100*a* closer to the high-pressure-stage impeller 5 in the axial direction X, a second connection portion 100*d* connecting the inner peripheral end of the first connection portion 100*c* to a tip end portion 100*b*, and the tip end portion 100*b*. The second connection portion 100*d* extends in an oblique direction that intersects each of the axial direction X and the radial direction Y so that it approaches the high-pressure-stage-side bearing 15B in the axial direction as it extends inward in the radial direction from the inner peripheral end of the first connection portion 100*c*. The tip end portion 100*b* of the lip seal 100 is thicker than each of the base end portion 100*a*, the first connection portion 100*c*, and the second connection portion 100*d*.

In the example shown in FIG. 6, the outer peripheral surface 181 of the high-pressure-stage-side sleeve 18B includes a large-diameter portion 181*a* and a small-diameter portion 181*b* with a smaller diameter than the large-diameter portion 181*a*. The large-diameter portion 181*a* is located between the small-diameter portion 181*b* and the high-pressure-stage impeller 5 and is adjacent to each of the small-diameter portion 181*b* and the high-pressure-stage impeller 5. The annular grooves 182 and 183 are formed in the large-diameter portion 181*a*, and the tip end portion 100*b* of the lip seal 100 is configured to come into contact with the small-diameter portion 181*b*.

With the configuration shown in FIG. 6, when the rotation of the rotational shaft 3 stops and when the rotational speed of the rotational shaft 3 is below a reference value, the tip end portion 100*b* of the lip seal 100 does not separate from the outer peripheral surface 181 of the high-pressure-stage-side sleeve 18B under the pressure of compressed air supplied from the compressed air supply hole 90 to the gap 25. Therefore, as shown in FIG. 6, the compressed air supplied to the gap 25 flows into the space 24 between the back surface 57 of the high-pressure-stage impeller 5 and the high-pressure-stage-side surface 167, and hardly flows to the high-pressure-stage-side bearing 15B.

In contrast, when the rotational speed of the rotational shaft 3 exceeds the reference value, the tip end portion 100*b* of the lip seal 100 separates from the outer peripheral surface 181 of the high-pressure-stage-side sleeve 18B due to the pressure of compressed air supplied from the compressed air supply hole 90 to the gap 25. Therefore, as shown in FIG. 7, the compressed air supplied to the gap 25 flows into the space 24 between the back surface 57 of the high-pressure-stage impeller 5 and the high-pressure-stage-side surface 167, and also flows to the high-pressure-stage-side bearing 15B and is discharged from the purge hole 92.

Figure 7:
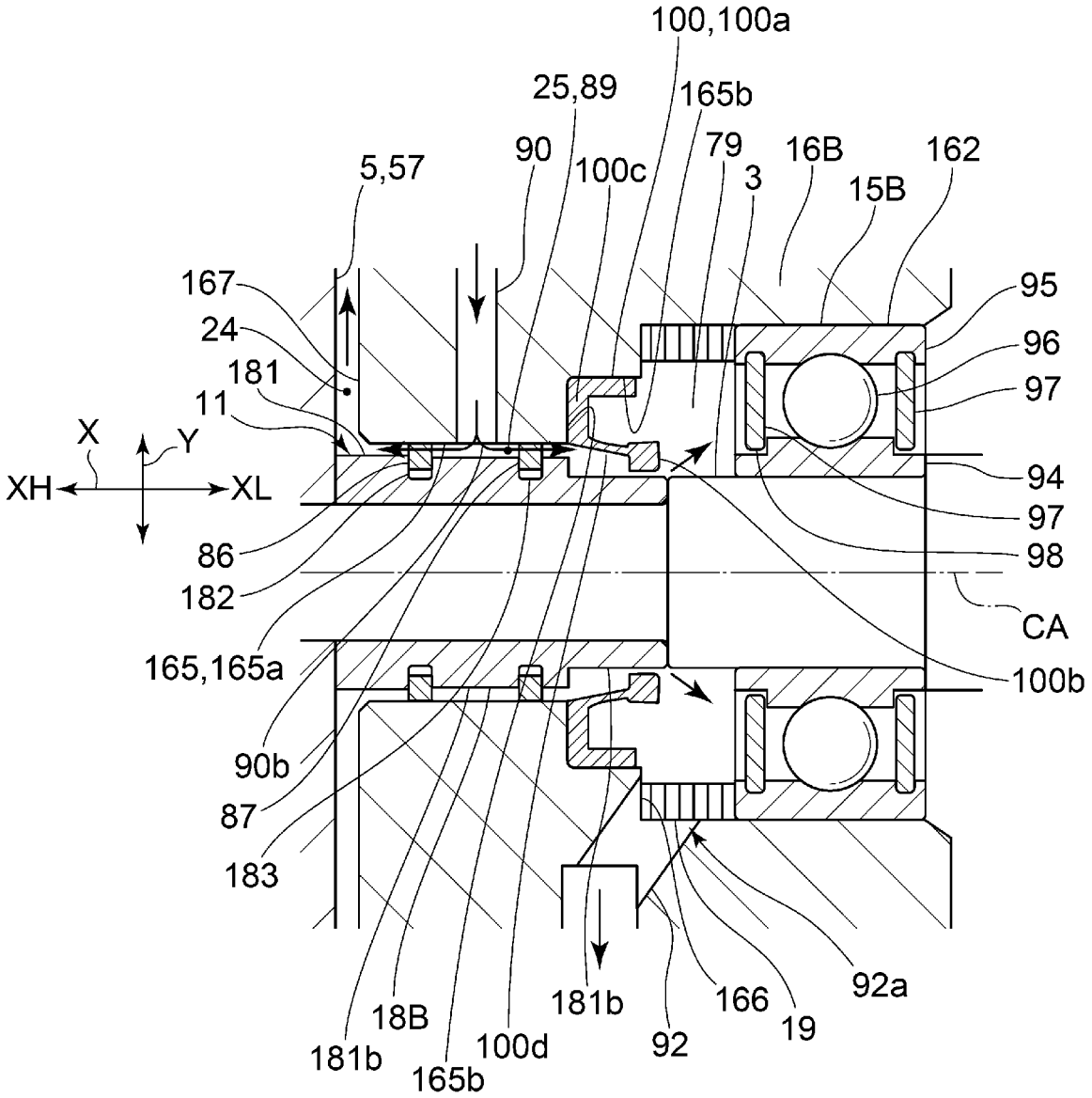
FIG. 7 is a schematic cross-sectional view showing the state where the rotational speed of the rotational shaft 3 of the electric centrifugal compressor 1 shown in FIG. 6 exceeds a reference value.

With the configuration shown in FIGS. 6 and 7, the grease in the high-pressure-stage-side bearing 15B is prevented from leaking through the gap 25 or the space 24 into the flow path in the high-pressure-stage housing 5 when the rotation of the rotational shaft 3 is stopped. This prevents the grease from mixing with the compressed gas compressed by the electric centrifugal compressor 1, so that the electric centrifugal compressor 1 can supply clean compressed gas to the fuel cell or the like.

Further, when the rotational speed of the rotational shaft 3 exceeds the reference value, the tip end portion 100*b* of the lip seal 100 separates from the outer peripheral surface 181 of the high-pressure-stage-side sleeve 18B, effectively suppressing the increased load on the electric motor 10 caused by contact between the tip end portion 100*b* of the lip seal 100 and the outer peripheral surface 181 of the high-pressure-stage-side sleeve 18B due to high rotational speed of the rotational shaft 3.

Figure 8:
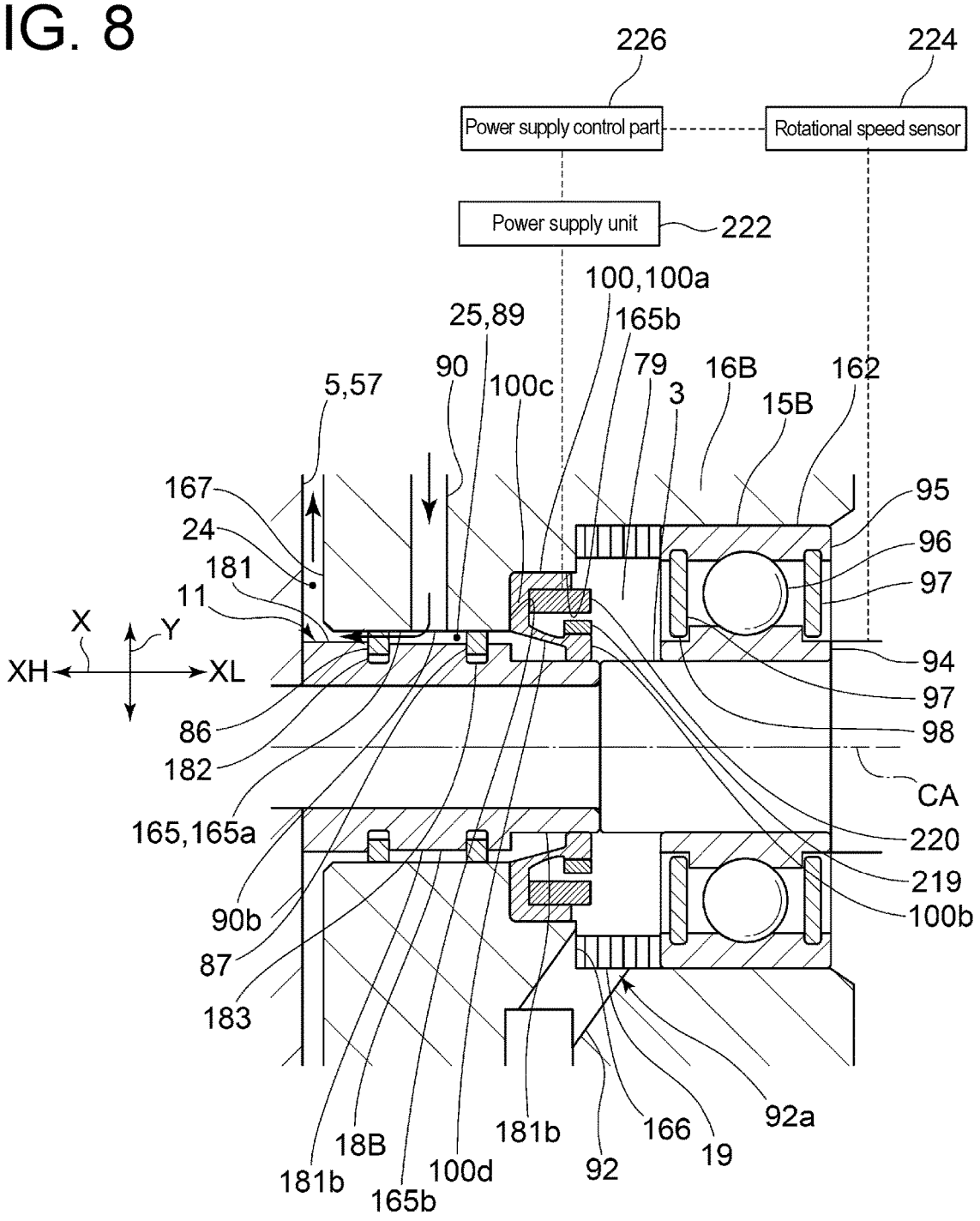
FIG. 8 is an enlarged view in the vicinity of a high-pressure-stage-side sleeve 18B of an electric centrifugal compressor 1 according to an embodiment and schematically shows a cross-section taken along a rotational axis CA of the electric centrifugal compressor 1.

In some embodiments, as shown in FIG. 8, the electric centrifugal compressor 1 includes a magnetic material 219 (e.g., iron) fixed to the tip end portion 100*b* of the lip seal 100, an electromagnet 220 for separating the tip end portion 100*b* of the lip seal 100 from the outer peripheral surface 181 of the rotating body 11, a power supply unit 222 configured to apply current to the electromagnet 220, a rotational speed sensor 224 for measuring the rotational speed of the rotational shaft 3, and a power supply control part 226 for controlling the power supply unit 222. In the illustrated example, the magnetic material 219 is fixed to the surface of the tip end portion 100*b* of the lip seal 100 opposite to the high-pressure-stage-side sleeve 18B.

The power supply control part 226 may be composed of an electric circuit or may be composed of a computer. When the power supply control part 226 is composed of a computer, it includes a storage device such as RAM (Random Access Memory) or ROM (Read Only Memory), and a processor such as CPU (Central Processing Unit) or GPU (Graphics Processing Unit), and the processor executes a program stored in the storage device to implement its functions.

The power supply control part 226 is configured to apply current to the electromagnet 220, based on the rotational speed of the rotational shaft 3 measured by the rotational speed sensor 224. For example, the power supply control part 226 may be configured to apply current to the electromagnet 220 to separate the tip end portion 100*b* of the lip seal 100 from the outer peripheral surface 181 of the rotating body 11 when the rotational speed of the rotational shaft 3 measured by the rotational speed sensor 224 exceeds a reference value.

With the configuration shown in FIG. 8, when the rotational speed of the rotational shaft 3 measured by the rotational speed sensor 224 is below the reference value, the power supply control part 226 does not apply current to the electromagnet 220, and thus the tip end portion 100*b* of the lip seal 100 does not separate from the outer peripheral surface 181 of the high-pressure-stage-side sleeve 18B only due to the pressure of compressed air supplied from the compressed air supply hole 90 to the gap 25. Therefore, as shown in FIG. 8, the compressed air supplied to the gap 25 flows into the space 24 between the back surface 57 of the high-pressure-stage impeller 5 and the high-pressure-stage-side surface 167, and hardly flows to the high-pressure-stage-side bearing 15B.

In contrast, when the rotational speed of the rotational shaft 3 measured by the rotational speed sensor 224 exceeds the reference value, the power supply control part 226 controls the power supply unit 222 to apply current to the electromagnet 220, so that the magnetic material 219 and the tip end portion 100*b* to which the magnetic material 219 is fixed can be attracted to the electromagnet 220 to separate the tip end portion 100*b* from the outer peripheral surface 181 of the high-pressure-stage-side sleeve 18B.

Figure 9:
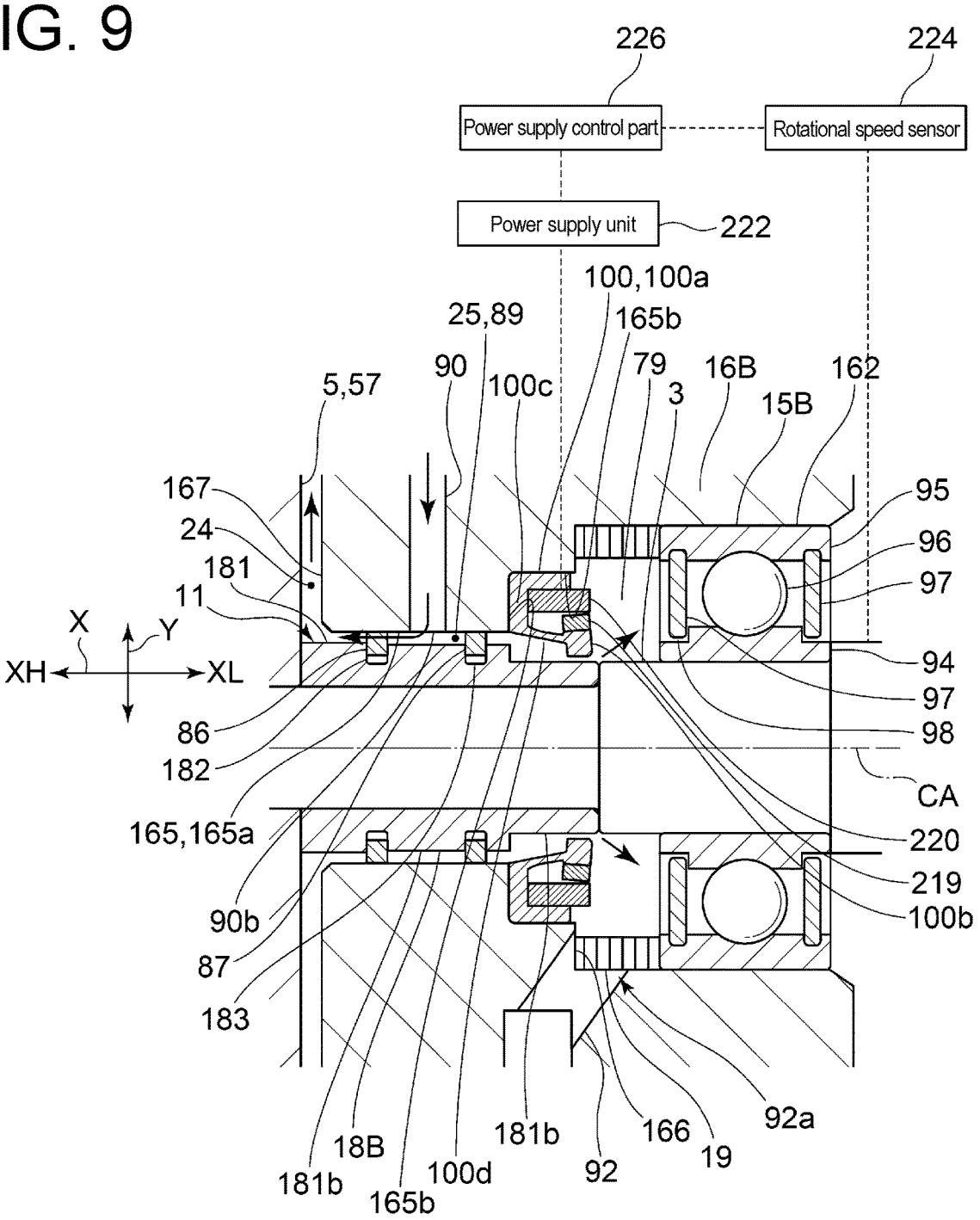
FIG. 9 is a schematic cross-sectional view showing the state where the rotational speed of the rotational shaft 3 of the electric centrifugal compressor 1 shown in FIG. 8 exceeds a reference value.

Therefore, as shown in FIG. 9, the compressed air supplied to the gap 25 flows into the space 24 between the back surface 57 of the high-pressure-stage impeller 5 and the high-pressure-stage-side surface 167, and also flows to the high-pressure-stage-side bearing 15B and is discharged from the purge hole 92.

With the configuration shown in FIGS. 8 and 9, when the rotational speed of the rotational shaft 3 is below the reference value, the grease in the low-pressure-stage-side bearing 15A is prevented from leaking through the gap 25 or the space 24 into the flow path in the low-pressure-stage housing 6. This prevents the grease from mixing with the compressed gas compressed by the electric centrifugal compressor 1, so that the electric centrifugal compressor 1 can supply clean compressed gas to the fuel cell or the like.

Further, when the rotational speed of the rotational shaft 3 exceeds the reference value, the tip end portion 100*b* of the lip seal 100 separates from the outer peripheral surface 181 of the high-pressure-stage-side sleeve 18B more reliably than in the configuration shown in FIGS. 6 and 7, effectively suppressing the increased load on the electric motor 10 caused by contact between the tip end portion 100*b* of the lip seal 100 and the outer peripheral surface 181 of the high-pressure-stage-side sleeve 18B due to high rotational speed of the rotational shaft 3.

(Negative Pressure Pump)

Figure 10:
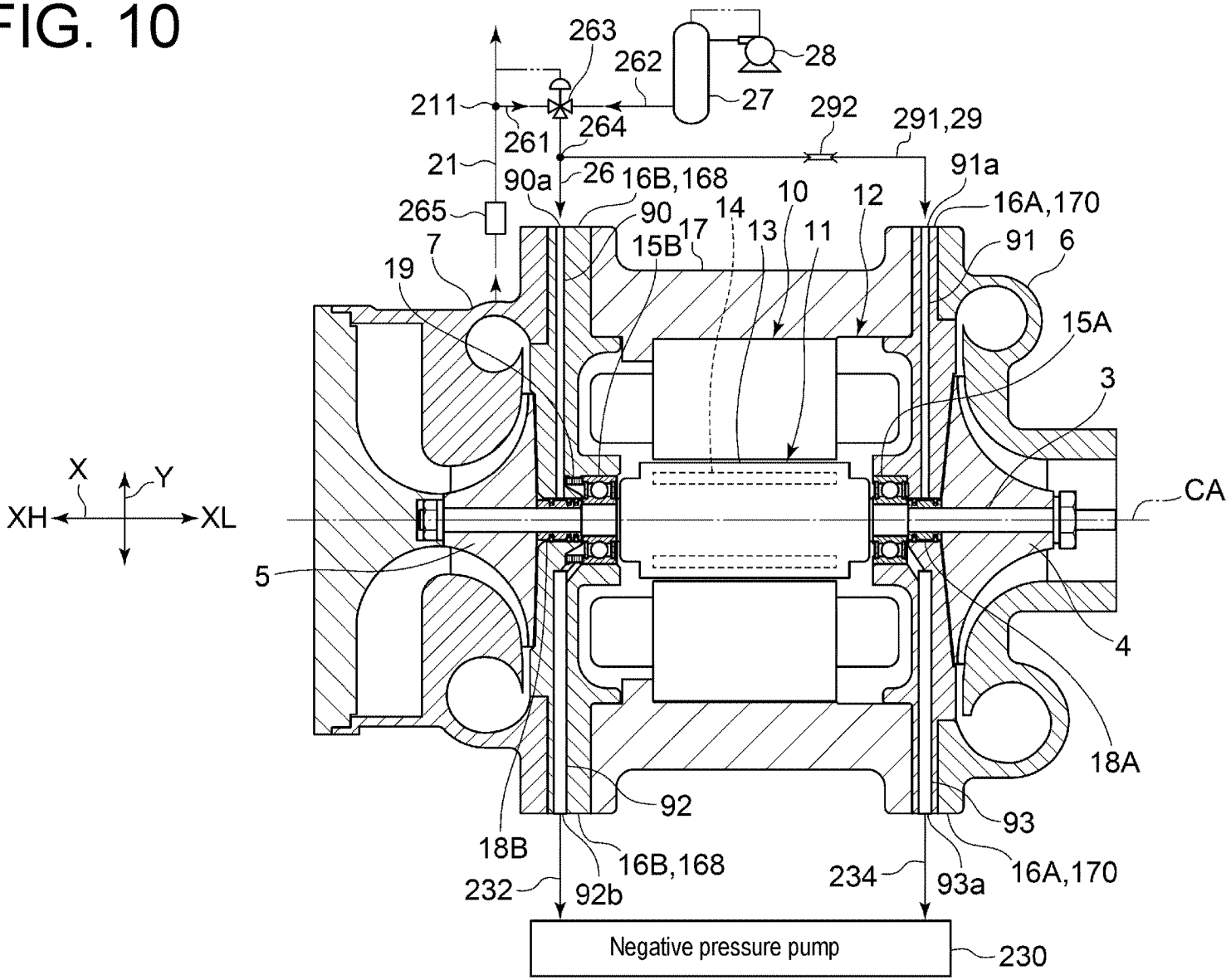
FIG. 10 is a cross-sectional view schematically showing a configuration of an electric centrifugal compressor 1 including a negative pressure pump 230.

In some embodiments, for example, as shown in FIG. 10, the electric centrifugal compressor 1 may further include a negative pressure pump 230 for sucking the air out of the purge hole 92 and the purge hole 93. The electric centrifugal compressor 1 shown in FIG. 10 further includes a purge line 232 connecting the outlet 92*b* of the purge hole 92 and the negative pressure pump 230, and a purge line 234 connecting the outlet 93*b* of the purge hole 93 and the negative pressure pump 230.

Further, the electric centrifugal compressor 1 shown in FIG. 10 further includes a pump control part 236 for controlling the negative pressure pump 230. The pump control part 236 is configured to operate the negative pressure pump 230 when the electric motor 10 is stopped to suck the air out of the purge hole 92 and the purge hole 93. The pump control part 236 may be composed of an electric circuit or may be composed of a computer. When the pump control part 236 is composed of a computer, it includes a storage device such as RAM (Random Access Memory) or ROM, and a processor such as CPU or GPU, and the processor executes a program stored in the storage device to implement its functions.

With the configuration shown in FIG. 10, by operating the negative pressure pump 230 to draw a vacuum inside the high-pressure-stage-side bearing housing 16B through the purge hole 92 when the electric motor 10 is stopped, the grease filled in the high-pressure-stage-side bearing 15B is prevented from leaking through the gap 25 or the space 24 into the flow path in the high-pressure-stage housing 7.

Further, by operating the negative pressure pump 230 to draw a vacuum inside the low-pressure-stage-side bearing housing 16A through the purge hole 93 when the electric motor 10 is stopped, the grease filled in the low-pressure-stage-side bearing 15A is prevented from leaking through the gap 38 or the space 33 into the flow path in the low-pressure-stage housing 6.

Therefore, even without the lip seal 100 as shown in FIGS. 6 to 10, the grease is effectively prevented from mixing with the compressed gas compressed by the electric centrifugal compressor 1, so that clean compressed gas can be supplied to the fuel cell or the like.

The present disclosure is not limited to the embodiments described above, but includes modifications to the embodiments described above, and embodiments composed of combinations of those embodiments.

For example, the above-described embodiments describe the multistage electric centrifugal compressor, but in other embodiments, it may be a single-stage electric centrifugal compressor.

In the embodiments described with reference to FIGS. 6 to 9, the electric centrifugal compressor 1 includes the lip seal 100 disposed so as to seal the gap 25 between the rotating body 11 including the rotational shaft 3 and the high-pressure-stage-side bearing housing 16B at a position between the seal element 87 and the high-pressure-stage-side bearing 15B in the axial direction X. In another embodiment, for example in the configuration shown in FIG. 5, the electric centrifugal compressor 1 may include a lip seal disposed so as to seal the gap 38 between the rotating body 11 including the rotational shaft 3 and the low-pressure-stage-side bearing housing 16A at a position between the seal element 204 and the low-pressure-stage-side bearing 15A in the axial direction X.

This prevents the grease in the low-pressure-stage-side bearing 15A from leaking through the gap 38 or the space 33 into the flow path in the low-pressure-stage housing 6 when the rotation of the rotational shaft 3 is stopped. This prevents the grease from mixing with the compressed gas compressed by the electric centrifugal compressor 1, so that the electric centrifugal compressor 1 can supply clean compressed gas to the fuel cell or the like.

The contents described in the above embodiments would be understood as follows, for instance.

(1) An electric centrifugal compressor (e.g., the above-described electric centrifugal compressor 1) according to the present disclosure includes: an electric motor (e.g., the above-described electric motor 10) including a rotational shaft (e.g., the above-described rotational shaft 3); a first impeller (e.g., the above-described low-pressure-stage impeller 4 or high-pressure-stage impeller 5) disposed on one end side of the rotational shaft; a first bearing (e.g., the above-described low-pressure-stage-side bearing 15A or high-pressure-stage-side bearing 15B) rotatably supporting the rotational shaft at a position between the first impeller and the electric motor and including a lubricant (e.g., the above-described grease); and a first bearing housing (e.g., the above-described low-pressure-stage-side bearing housing 16A or high-pressure-stage-side bearing housing 16B) accommodating the first bearing. The first bearing housing includes a compressed gas supply hole (e.g., the above-described compressed air supply hole 90 or compressed air supply hole 91) for supplying a compressed gas from outside of the first bearing housing to a gap (e.g., the above-described gap 25 or gap 38) between a rotating body (e.g., the above-described rotating body 11) including the rotational shaft and the first bearing housing. An outlet (e.g., the above-described outlet 90*b* or outlet 91*b*) of the compressed gas supply hole is disposed on an inner surface of the first bearing housing and is located between the first impeller and the first bearing in an axial direction of the rotational shaft.

With the electric centrifugal compressor described in the above (1), the compressed gas is supplied from the compressed gas supply hole of the first bearing housing to the gap between the rotating body and the first bearing housing, thereby suppressing leakage flow from the space adjacent to the back surface of the first impeller to the first bearing. This suppresses the deterioration of lubricant in the first bearing caused by the leakage flow, thereby improving the durability and increasing the service life of the first bearing.

Additionally, the lubricant in the first bearing is prevented from leaking to the mainstream flow path in the first impeller through the gap between the rotating body and the first bearing housing or the space adjacent to the back surface of the first impeller. This prevents the lubricant from mixing with the compressed gas compressed by the electric centrifugal compressor, so that the electric centrifugal compressor can discharge clean compressed gas. Additionally, since the lubricant is prevented from mixing with the compressed gas produced even using the first bearing including the lubricant, compared to the case where an air bearing is used to produce clean compressed gas, the structure of parts around the first bearing can be simplified, and thus the size and weight of the electric centrifugal compressor can be reduced.

(2) In some embodiments, the electric centrifugal compressor described in the above (1) further includes: a first seal element (e.g., the above-described seal element 86 or seal element 202) disposed so as to seal the gap at a position between the first impeller and the outlet of the compressed gas supply hole in the axial direction; and a second seal element (e.g., the above-described seal element 87, seal element 88, or seal element 204) disposed so as to seal the gap at a position between the outlet of the compressed gas supply hole and the first bearing in the axial direction.

With the electric centrifugal compressor described in the above (2), in the gap between the rotating body and the first bearing housing, the outlet of the compressed gas supply hole is provided in the space between the first seal element and the second seal element. Thus, leakage flow from the space adjacent to the back surface of the first impeller to the first bearing is effectively suppressed, and the lubricant in the first bearing is effectively prevented from leaking to the mainstream flow path in the first impeller through the gap between the rotating body and the first bearing housing or the space adjacent to the back surface of the first impeller.

(3) In some embodiments, the electric centrifugal compressor described in the above (2) further includes a third seal element (e.g., the above-described seal element 88) disposed so as to seal the gap at a position between the second seal element (e.g., the above-described seal element 87) and the first bearing in the axial direction.

With the electric centrifugal compressor described in the above (3), the lubricant in the first bearing is effectively prevented from leaking to the mainstream in the first impeller through the gap between the rotating body and the first bearing housing or the space adjacent to the back surface of the first impeller.

(4) In some embodiments, the electric centrifugal compressor described in the above (2) or (3) further includes a compressed gas introduction line (e.g., the above-described compressed air introduction line 26 or compressed air introduction line 29) configured to introduce the compressed gas to an inlet (e.g., the above-described inlet 90*a* or inlet 91*a*) of the compressed gas supply hole so that a pressure in a space of the gap between the first seal element and the second seal element is larger than a pressure in a space (e.g., the above-described space 24 or space 33) of the gap adjacent to a back surface of the first impeller.

With the electric centrifugal compressor described in the above (4), since the pressure in the space of the gap between the first seal element and the second seal element is larger than the pressure in the space adjacent to the back surface of the first impeller, it is possible to effectively suppress leakage flow from the space adjacent to the back surface of the first impeller to the first bearing.

(5) In some embodiments, the electric centrifugal compressor described in any one of the above (2) to (4) further includes a lip seal (e.g., the above-described lip seal 100) disposed so as to seal the gap at a position between the second seal element and the first bearing in the axial direction.

With the electric centrifugal compressor described in the above (5), when the rotation of the rotational shaft is stopped, the lubricant in the first bearing is effectively prevented from leaking to the mainstream in the first impeller through the gap or the space adjacent to the back surface of the impeller.

(6) In some embodiments, in the electric centrifugal compressor described in the above (5), a base end portion (e.g., the above-described base end portion 100*a*) of the lip seal is fixed to the first bearing housing, and a tip end portion (e.g., the above-described tip end portion 100*b*) of the lip seal is configured to come into contact with an outer peripheral surface of the rotating body.

With the electric centrifugal compressor described in the above (6), when the rotation of the rotational shaft is stopped, the lubricant in the first bearing is effectively prevented from leaking to the mainstream in the first impeller through the gap or the space adjacent to the back surface of the impeller.

(7) In some embodiments, the electric centrifugal compressor described in the above (6) further includes an electromagnet (e.g., the above-described electromagnet 220) for separating the tip end portion of the lip seal from the outer peripheral surface of the rotating body.

With the electric centrifugal compressor described in the above (7), by applying current to the electromagnet to separate the tip end portion of the lip seal from the outer peripheral surface of the rotating body, it is possible to suppress the increased load on the electric motor due to the lip seal sliding against the outer peripheral surface of the rotating body.

(8) In some embodiments, the electric centrifugal compressor described in the above (7) includes: a power supply unit (e.g., the above-described power supply unit 222) configured to apply current to the electromagnet; a rotational speed sensor (e.g., the above-described rotational speed sensor 224) for measuring rotational speed of the rotational shaft; and a power supply control part (e.g., the above-described power supply control part 226) for controlling the power supply unit. The power supply control part is configured to apply current to the electromagnet, based on the rotational speed of the rotational shaft measured by the rotational speed sensor.

With the electric centrifugal compressor described in the above (8), by applying current to the electromagnet based on the rotational speed of the rotational shaft, it is possible to suppress the increased load on the electric motor according to the rotational speed of the rotational shaft.

(9) In some embodiments, in the electric centrifugal compressor described in the above (8), the power supply control part is configured to apply current to the electromagnet to separate the tip end portion of the lip seal from the outer peripheral surface of the rotating body when the rotational speed of the rotational shaft measured by the rotational speed sensor exceeds a reference value.

With the electric centrifugal compressor described in the above (9), it is possible to effectively suppress the increased load on the electric motor caused by contact between the tip end portion of the lip seal and the outer peripheral surface of the rotating body when the rotational speed of the rotational shaft is larger than the reference value.

(10) In some embodiments, in the electric centrifugal compressor described in any one of the above (2) to (9), the first bearing housing includes a purge hole (e.g., the above-described purge hole 92 or purge hole 93) for discharging the compressed gas supplied from the compressed gas supply hole to the gap to outside of the first bearing housing. An inlet (e.g., the above-described inlet 92*a* or inlet 93*a*) of the purge hole is disposed on the inner surface of the first bearing housing and is located between the first impeller and the first bearing in the axial direction.

With the electric centrifugal compressor described in the above (10), the compressed gas supplied to the gap between the rotating body and the first bearing housing is discharged to the outside of the first bearing housing through the purge hole, so that the compressed gas supplied to the gap is prevented from entering the inside of the first bearing. This suppresses the deterioration of lubricant in the first bearing, thereby improving the durability and increasing the service life of the first bearing.

(11) In some embodiments, in the electric centrifugal compressor described in the above (10), the first bearing includes an inner ring (e.g., the above-described inner ring 94 or inner ring 212), an outer ring (e.g., the above-described outer ring 95 or outer ring 213), a plurality of rolling elements (e.g., the above-described plurality of balls 96 or plurality of balls 214) held between the inner ring and the outer ring, and a pair of annular seal plates (e.g., the above-described pair of annular seal plates 97 or pair of annular seal plates 215) located on both sides of the rolling elements in the axial direction and held by the outer ring. When an annular gap formed between the inner ring and an annular seal plate of the pair of annular seal plates closer to the first impeller is defined as a seal plate gap (e.g., the above-described seal plate gap 98 or seal plate gap 216), a path cross-sectional area of the purge hole is larger than a cross-sectional area of the seal plate gap perpendicular to the axial direction.

With the electric centrifugal compressor described in the above (11), since the purge hole has a larger path cross-sectional area than the cross-sectional area of the seal plate gap, the flow of the compressed gas supplied to the gap between the rotating body and the first bearing housing into the purge hole is encouraged, and the compressed gas is prevented from entering the inside of the first bearing through the gap between the rotating body and the first bearing housing. This suppresses the deterioration of lubricant in the first bearing, thereby improving the durability and increasing the service life of the first bearing.

(12) In some embodiments, the electric centrifugal compressor described in the above (10) or (11) further includes a negative pressure pump (e.g., the above-described negative pressure pump 230) for sucking a gas out of the purge hole.

With the electric centrifugal compressor described in the above (12), by operating the negative pressure pump to suck the air inside the first bearing housing out of the purge hole when the electric motor is stopped, the lubricant in the first bearing is effectively prevented from leaking to the mainstream in the first impeller through the gap between the rotating body and the first bearing housing or the space adjacent to the back surface of the first impeller.

(13) In some embodiments, the electric centrifugal compressor described in the above (12) further includes a pump control part (e.g., the above-described pump control part 236) for controlling the negative pressure pump. The pump control part is configured to operate the negative pressure pump when the electric motor is stopped.

With the electric centrifugal compressor described in the above (13), by automatically operating the negative pressure pump to suck the air inside the first bearing housing out of the purge hole when the electric motor is stopped, the lubricant in the first bearing is effectively prevented from leaking to the mainstream in the first impeller through the gap between the rotating body and the first bearing housing or the space adjacent to the back surface of the first impeller.

(14) In some embodiments, the electric centrifugal compressor described in any one of the above (1) to (13) is a multistage electric centrifugal compressor and includes: a second impeller (e.g., the above-described low-pressure-stage impeller 4 or high-pressure-stage impeller 5) disposed on another end side of the rotational shaft; a second bearing (e.g., the above-described low-pressure-stage-side bearing 15A or high-pressure-stage-side bearing 15B) rotatably supporting the rotational shaft at a position between the second impeller and the electric motor and including a lubricant (e.g., the above-described grease); and a second bearing housing (e.g., the above-described low-pressure-stage-side bearing housing 16A or high-pressure-stage-side bearing housing 16B) accommodating the second bearing. The second bearing housing includes a compressed gas supply hole (e.g., the above-described compressed air supply hole 90 or compressed air supply hole 91) for supplying a compressed gas to a gap (e.g., the above-described gap 25 or gap 38) between a rotating body including the rotational shaft and the second bearing housing. An outlet (e.g., the above-described outlet 90*b* or outlet 91*b*) of the compressed gas supply hole is located between the second impeller and the second bearing in the axial direction.

With the electric centrifugal compressor described in the above (14), the compressed gas is supplied from the compressed gas supply hole of the second bearing housing to the gap between the rotating body and the second bearing housing, thereby suppressing leakage flow from the space adjacent to the back surface of the second impeller to the second bearing. This suppresses the deterioration of lubricant in the second bearing caused by the leakage flow, thereby improving the durability and increasing the service life of the second bearing.

Additionally, the lubricant in the second bearing is prevented from leaking to the mainstream flow path in the second impeller through the gap between the rotating body and the second bearing housing or the space adjacent to the back surface of the second impeller. This prevents the lubricant from mixing with the compressed gas compressed by the electric centrifugal compressor, so that the electric centrifugal compressor can discharge clean compressed gas.

(15) In some embodiments, the electric centrifugal compressor described in the above (14) includes a low-pressure-stage housing (e.g., the above-described low-pressure-stage housing 6) accommodating the first impeller; a high-pressure-stage housing (e.g., the above-described high-pressure-stage housing 7) accommodating the second impeller; and a connecting pipe (e.g., the above-described connecting pipe 8) for supplying a compressed gas compressed by the first impeller to the high-pressure-stage housing. The high-pressure-stage housing has a high-pressure-stage inlet opening (e.g., the above-described high-pressure-stage inlet opening 71) that opens in a direction intersecting an axis of the rotational shaft. The connecting pipe is connected to the high-pressure-stage inlet opening.

With the electric centrifugal compressor described in the above (15), the high-pressure-stage housing has the high-pressure-stage inlet opening that opens in a direction intersecting the axis of the rotational shaft, and the connecting pipe is connected to the high-pressure-stage inlet opening. Accordingly, the compressed gas pressurized by the first impeller is supplied from the outer peripheral side of the high-pressure-stage housing into the high-pressure-stage housing through the connecting pipe. In this case, as compared to the case where the compressed gas is introduced into the high-pressure-stage housing along the axial direction of the rotational shaft, the length of the connecting pipe and the high-pressure-stage housing in the axial direction can be shortened. As a result, the length of the multistage electric centrifugal compressor in the axial direction can be shortened, so that the size and weight of the multistage electric centrifugal compressor can be reduced. Further, a high pressure ratio can be achieved at low flow rates and a multistage electric centrifugal compressor with excellent thrust load balance can be achieved.

REFERENCE SIGNS LIST

1 Electric centrifugal compressor
3 Rotational shaft
4 Low-pressure-stage impeller
5 High-pressure-stage impeller
6 Low-pressure-stage housing
7 High-pressure-stage housing
8 Connecting pipe
10 Electric motor
11 Rotating body
12 Motor stator
13 Rotor assembly
14 Permanent magnet
15A Low-pressure-stage-side bearing
15B High-pressure-stage-side bearing
16A Low-pressure-stage-side bearing housing
16B High-pressure-stage-side bearing housing
17 Stator housing
18A Low-pressure-stage-side sleeve
18B High-pressure-stage-side sleeve
19 Pressurizing spring
21 Compressed air supply line
24, 33, 79, 89, 206, 208 Space
25, 38 Gap
26, 29 Compressed air introduction line
27 Surge tank
28 Compressor
30, 57 Back surface
32 Low-pressure-stage-side surface
34, 181 Outer peripheral surface
36, 165 Inner surface
41, 51 Hub
43, 53 Impeller blade
61 Low-pressure-stage inlet opening
62 Low-pressure-stage outlet opening
63, 73 Supply passage
64, 74 Scroll passage
66 Low-pressure-stage impeller chamber
71 High-pressure-stage inlet opening
72 High-pressure-stage outlet opening
76 High-pressure-stage impeller chamber
81 High-pressure-stage-side connection portion
82 Low-pressure-stage-side connection portion
83 Intermediate portion
84 Low-pressure-stage-side curved portion
85 High-pressure-stage-side curved portion
86, 87, 88, 202, 204 Seal element
90, 91 Compressed air supply hole
90*a*, 91*a*, 92*a*, 93*a* Inlet
90*b*, 91*b*, 92*b*, 93*b* Outlet
92, 93 Purge hole
94, 212 Inner ring
95, 213 Outer ring
96, 214 Ball
97, 215 Annular seal plate
98, 216 Seal plate gap
100 Lip seal
100*a* Base end portion
100*b* Tip end portion
100*c* First connection portion
100*d* Second connection portion
161, 162 Bearing support surface
164, 166 Engagement surface
165*a* First inner surface
165*b* Stepped surface
165*c* Second inner surface
167 High-pressure-stage-side surface
168, 170 Outer surface
181*a* Large-diameter portion
181*b* Small-diameter portion
182, 183, 184, 203, 205 Annular groove
211, 264 Branch portion
219 Magnetic material
220 Electromagnet
222 Power supply unit
224 Rotational speed sensor
226 Power supply control part
230 Negative pressure pump
232, 234 Purge line
236 Pump control part
261 First pipe
262 Second pipe
263 Switching device
291 Third pipe
292 Pressure reducing valve
CA Axis (of rotational shaft)
X Axial direction
XH High-pressure stage side (in axial direction)
XL Low-pressure stage side (in axial direction)
Y Radial direction

The invention claimed is:

1. An electric centrifugal compressor, comprising:

an electric motor including a rotational shaft;

a first impeller disposed on one end side of the rotational shaft;

a first bearing rotatably supporting the rotational shaft at a position between the first impeller and the electric motor and including a lubricant; and a first bearing housing accommodating the first bearing, and a biasing spring configured to bias the first bearing to a side opposite to the first impeller;

wherein the first bearing housing includes a compressed gas supply hole for supplying a compressed gas from outside of the first bearing housing to a gap between a rotating body including the rotational shaft and the first bearing housing, and wherein an outlet of the compressed gas supply hole is disposed on an inner surface of the first bearing housing and is located between the first impeller and the first bearing in an axial direction of the rotational shaft, wherein the electric centrifugal compressor further comprises:

a first seal element disposed so as to seal the gap at a position between the first impeller and the outlet of the compressed gas supply hole in the axial direction;

a second seal element disposed so as to seal the gap at a position between the outlet of the compressed gas supply hole and the first bearing in the axial direction;

a compressed gas introduction line configured to introduce compressed gas to an inlet of the compressed gas supply hole so that a pressure in a space of the gap between the first seal element and the second seal element is larger than a pressure in a space of the gap adjacent to a back surface of the first impeller; and a cooler provided in the compressed gas introduction line for cooling the compressed gas, and a lip seal provided at a position between the second seal element and the first bearing in the axial direction so as to seal the gap, the lip seal being configured to separate from an outer peripheral surface of the rotating body by a pressure of the compressed gas supplied from the compressed gas supply hole to the gap when a rotational speed of the rotational shaft exceeds a reference value;

wherein the first bearing housing includes an annular space configured to accommodate the biasing spring, the annular space communicating with a region between the second seal element and the first bearing, wherein the first bearing housing includes a purge hole for discharging the compressed gas supplied from the compressed gas supply hole to the gap to outside of the first bearing housing, and wherein an inlet of the purge hole is disposed on the inner surface of the first bearing housing and is located between the second seal element and the first bearing in the axial direction and communicates with the annular space.

2. The electric centrifugal compressor according to claim 1, further comprising a third seal element disposed so as to seal the gap at a position between the second seal element and the first bearing in the axial direction.

3. The electric centrifugal compressor according to claim 1, wherein a base end portion of the lip seal is fixed to the first bearing housing, and a tip end portion of the lip seal is configured to come into contact with the outer peripheral surface of the rotating body.

4. The electric centrifugal compressor according to claim 1, wherein the first bearing includes an inner ring, an outer ring, a plurality of rolling elements held between the inner ring and the outer ring, and a pair of annular seal plates located on both sides of the rolling elements in the axial direction and held by the outer ring, and wherein, when an annular gap formed between the inner ring and an annular seal plate of the pair of annular seal plates closer to the first impeller is defined as a seal plate gap, a path cross-sectional area of the purge hole is larger than a cross-sectional area of the seal plate gap perpendicular to the axial direction.

5. The electric centrifugal compressor according to claim 1, further comprising a negative pressure pump for sucking a gas out of the purge hole.

6. The electric centrifugal compressor according to claim 5, further comprising a pump control part for controlling the negative pressure pump, wherein the pump control part is configured to operate the negative pressure pump when the electric motor is stopped.

7. The electric centrifugal compressor according to claim 1, wherein the electric centrifugal compressor is a multistage electric centrifugal compressor, wherein the electric centrifugal compressor comprises:

a second impeller disposed on another end side of the rotational shaft;

a second bearing rotatably supporting the rotational shaft at a position between the second impeller and the electric motor and including a lubricant; and a second bearing housing accommodating the second bearing, wherein the second bearing housing includes a compressed gas supply hole for supplying a compressed gas to a gap between the rotating body and the second bearing housing, and wherein an outlet of the compressed gas supply hole of the second bearing housing is located between the second impeller and the second bearing in the axial direction.

8. The electric centrifugal compressor according to claim 7, comprising:

a low-pressure-stage housing accommodating the first impeller;

a high-pressure-stage housing accommodating the second impeller; and a connecting pipe for supplying a compressed gas compressed by the first impeller to the high-pressure-stage housing, wherein the high-pressure-stage housing has a high-pressure-stage inlet opening that opens in a direction intersecting an axis of the rotational shaft, and wherein the connecting pipe is connected to the high-pressure-stage inlet opening.

* * * * *